US010435204B2

(12) United States Patent
Stein

(10) Patent No.: US 10,435,204 B2
(45) Date of Patent: Oct. 8, 2019

(54) TAMPER EVIDENT FOOD CONTAINER WITH ACCORDIATED PULL TAB

(71) Applicant: Anchor Packaging, Inc., St. Louis, MO (US)

(72) Inventor: Bruce Stein, Ballwin, MO (US)

(73) Assignee: Anchor Packaging, LLC, St. Louis, MO (US)

( * ) Notice: Subject to any disclaimer, the term of this patent is extended or adjusted under 35 U.S.C. 154(b) by 154 days.

(21) Appl. No.: 15/668,929

(22) Filed: Aug. 4, 2017

(65) Prior Publication Data

US 2019/0039789 A1 Feb. 7, 2019

(51) Int. Cl.
*B65D 17/34* (2006.01)
*B65D 17/32* (2006.01)
(Continued)

(52) U.S. Cl.
CPC ..... *B65D 43/0235* (2013.01); *B65D 43/169* (2013.01); *B65D 55/024* (2013.01);
(Continued)

(58) Field of Classification Search
CPC .... B65D 77/32; B65D 77/20; B65D 77/2032; B65D 77/2028; B65D 77/34; B65D 77/36; B65D 75/66; B65D 43/0235; B65D 43/0092; B65D 43/00833; B65D 2543/0092; B65D 2543/00833; B65D 55/0818; B65D 55/06; B65D 55/02; B65D 55/024; B65D 2101/0092; B65D 2517/0013; B65D 2101/0061; G09F 2003/0222
(Continued)

(56) References Cited

U.S. PATENT DOCUMENTS 3,298,505 A * 1/1967 Stephenson ..... B65D 77/2008 206/772
3,301,465 A * 1/1967 Flaherty ..... B65D 77/2008 220/620
(Continued)

OTHER PUBLICATIONS

International Search Report and Written Opinion dated Oct. 4, 2018 in co-pending PCT/US2018/045325.

*Primary Examiner* — Gideon R Weinerth
(74) *Attorney, Agent, or Firm* — Don V. Kelly; Evans & Dixon, L.L.C.

(57) ABSTRACT

A plastic container capable of assuming a loading state, an initially sealed state and an opened state comprises a lid including a lid rim and a base having a base rim. The lid rim sealingly engages with the base rim. A projecting portion has an accordiated section and a pull tab that projects outwardly from the lid. The accordiated section has at least one pleat. The projecting portion includes a frangible bridge. When the plastic food container is in the initially sealed state, the accordiated section has a first length and a first orientation relative to the projecting portion. When the container is in the initially sealed state and a first pulling force is applied to the pull tab, the frangible bridge ruptures. When the frangible bridge ruptures and before the lid is separated from the base, the container is in a tab-employed state in which the accordiated section springs outward and has a second length visibly longer than the first length.

24 Claims, 37 Drawing Sheets

(51) Int. Cl.
*B65D 17/28* (2006.01)
*B65D 43/02* (2006.01)
*B65D 55/02* (2006.01)
*B65D 43/16* (2006.01)

(52) U.S. Cl.
CPC ..... *B65D 2101/0023* (2013.01); *B65D 2543/00092* (2013.01); *B65D 2543/00833* (2013.01)

(58) Field of Classification Search
USPC ..... 220/270, 266, 279, 277, 214, 254.1, 220/359.2, 269, 805; 229/238, 239, 229/160.2, 240, 924, 87.05, 123.1, 123.2, 229/309, 310, 311, 313, 237, 927; 428/181, 182, 571; 53/133.6, 133.7, 53/133.8; 215/901; 383/5; 206/772
See application file for complete search history.

(56) References Cited

U.S. PATENT DOCUMENTS 4,434,908 A * 3/1984 French ..... B65D 17/163 220/270
4,560,082 A * 12/1985 Sutch ..... B29C 45/26 220/270
4,670,352 A * 6/1987 Kurz ..... B65D 43/0268 220/780
5,725,120 A * 3/1998 Ramsey ..... B65D 17/502 220/276
9,187,209 B1 * 11/2015 Hanna ..... B65D 43/162
9,796,511 B2 10/2017 Cimmerer
2005/0017007 A1 1/2005 Sellari et al.
2007/0045317 A1 3/2007 Rosender et al.
2008/0035641 A1 * 2/2008 Foldesi ..... B65D 43/0249 220/276
2010/0084401 A1 * 4/2010 Golota ..... B65D 43/0249 220/270
2010/0181323 A1 7/2010 Thaler
2010/0224630 A1 9/2010 Petlak
2011/0000914 A1 * 1/2011 Jouillat ..... B65D 17/502 220/270
2011/0031246 A1 * 2/2011 Massey, Jr. ..... B65D 43/0249 220/214
2011/0192860 A1 * 8/2011 Abrahamsson .... B65D 43/0204 220/805
2012/0292322 A1 11/2012 Meyer et al.
2014/0190969 A1 * 7/2014 Huang ..... B65D 77/2032 220/268
2014/0224804 A1 * 8/2014 Pickering ..... B65D 85/72 220/270
2015/0266611 A1 * 9/2015 Dow ..... B65D 43/162 220/269
2015/0298853 A1 10/2015 Chen
2016/0332789 A1 * 11/2016 Yerecic ..... B65D 55/024
2016/0347515 A1 * 12/2016 Hsieh ..... B65D 43/0272
2017/0107031 A1 * 4/2017 Hsieh ..... B65D 43/14
2017/0166362 A1 * 6/2017 Kalmanides ..... B65D 43/0237
2018/0141731 A1 * 5/2018 Hsieh ..... B65D 55/024
2019/0039789 A1 * 2/2019 Stein ..... B65D 43/0235

* cited by examiner

TAMPER EVIDENT FOOD CONTAINER WITH ACCORDIATED PULL TAB

CROSS REFERENCE TO RELATED APPLICATION

Not Applicable.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to plastic food containers. The invention is more specifically related to resealable plastic food containers having tamper evident sealing mechanisms.

BACKGROUND OF THE INVENTION

It is known to use plastic containers in the food preparation and restaurant industry to package prepared foods. The typical food container of the prior art consists of a clear or solid colored base and a clear lid. In order to maintain the quality of food contents and prevent tampering with the contents of a sealed container, it is desirable that the food container, once initially sealed, not be capable of being initially opened without visible indication of the container having been opened. To achieve this feature, container manufacturers have designed containers having integral tamper evident features. Typically, these containers consist of a lid that is hingedly attached to a base. The lid seals to the base by superposing the rim of the lid upon the rim of the base. These types of plastic containers are sold as one-piece containers and are often referred to as "clamshell" containers or packages.

In one type of hinged tamper evident container, the lid and base each have interlocking elements respectively located on or near the lid rim and base rim where the two rims meet when the container is sealed (i.e., at a non-hinged side or portion of the container). The interlocking element of the lid or base is conventionally located on a tab or flange extending from the rim of the lid or base. Either or both of the tabs are attached to their respective rims by a frangible section of plastic. When the lid and base are placed in initial sealing arrangement, the interlocking elements on or near the lid rim and base rim engage and lock together. In order to open the initially sealed container, the frangible section of one or both tabs must be ruptured so as to release the tab or tabs from the container. Because the interlocking sealing elements are located on the tabs, rupturing one or more tabs from the container disables the locking mechanism. The ruptured tab provides evidence of the container having been opened. One shortcoming with the prior art food container described above is that the interlocked tabs can be cut from the container in clean fashion using scissors or another cutting implement so as to remove any indicia of the container having had a tamper evident mechanism. Also, with many tamper evident containers, one rim (typically the lid rim) superposes over the other rim (typically the base rim) such that at least one of the rim edges is exposed and subject to manipulation. With this type of sealing arrangement and construct in plastic containers, the lid and base can be partially pried open by inserting a thin object underneath an exposed rim edge at a point on the container distal from the tamper indicator. By partially prying open the rims in this fashion, one can doctor or tamper with the contents of the apparently sealed container without activating the tamper indicator.

In view of the issues presented by incorporating a tamper evident mechanism in the meeting rims of the hinged container, some manufacturers have incorporated tamper evident features as part of the structure that forms or includes the hinge. In these containers, the container is designed to require a severance near the hinge in order to unseal (initially open) the container. This construct make the hinge a single use hinge. These containers typically employ a square-shaped hinge arrangement (as seen from the side when the container is closed) in which the flange of the lid rim extends beyond the lid rim and then near-perpendicularly connects to a vertical segment that descends down from the lid flange. The vertical segment meets an extended portion of the base flange in similar near-perpendicular arrangement. The two flanges generally run parallel to each other and by their connection to the vertical segment form three sides of a square.

Square-shaped hinge containers suffer from a variety of deficits. One is a tendency of the container not to remain fully open for purposes of filling the container. The memory of the square hinge mechanism is such that the lid tends to rotate and cover all or part of the base. Another deficit is that the squeezing action required must move two adjacent, near perpendicular sides of the hinge structure and therefore the entire hinge structure must be effectively crushed in order to break the frangible line located at the bottom outside corner of the hinge structure. Thus, in order to rupture the frangible line, a squeezing force is applied to the entire box structure of the hinge area. This extended crushing motion may require the container to be stabilized with one's other hand in order to entirely rupture the frangible section.

Other tamper evident solutions involve using tabs that when activated remain attached to the container in a deformed condition and provide visible indication of the opening of the container. U.S. Published Patent Application No. 20100181323 (Thaler) is an example of one such tamper evident solution. This reference discloses a plastic food container that includes a lid adapted for sealing arrangement with a base. The rim of the base has an undercut formation adapted to receive the perimeter flange and flange tab of the lid when the lid and base are in the sealed arrangement. The flange tab includes an undercut release mechanism that allows a user to grasp a portion of the flange tab and initially open a sealed container via the extraction of the flange tab from the undercut formation by application of a pulling force to the undercut release mechanism. The flange tab includes tamper evident means that provides visible indication that the undercut release mechanism has been utilized to initially open the sealed container. A similar suggested tamper evident mechanism for food containers is that of U.S. 20100224630 (Petlak). With this tamper evident mechanism, a pull tab extends outwardly from at least one of the base or the cover. The surface of the pull tab has a series of grooves such that when the tab is partially separated from the lid or base via a pulling force, the tab is supposed to curl. This curling is intended to provide a visible deformation, which would be a signal to an end user that the container has been opened. With the containers of Thaler and Petlak, the lid rim inserts into the base rim to seal the container and therefore the pull tab must be extracted from within the confines of the base rim. This requires a complicated tab structure, as well as a tab and base rim mating arrangement.

In view of the features and deficits of the prior art containers, there is thus a need in the art for a re-closable plastic food container that is easy for end consumers to operate; combines reliable tamper evidence and defense against prying intrusion; and that uses a minimum of material to manufacture.

SUMMARY OF THE INVENTION

The present invention satisfies the needs in the art and provides an aesthetically appealing food container that is easy to use and that is both tamper resistant and tamper evident. In this respect the present invention food container comprises a plastic food container having a lid adapted for tight sealing arrangement with a base. An embodiment plastic food container of the present invention is capable of assuming a loading state, an initially sealed state, a tab-employed state and an opened state. The embodiment plastic food container comprises a lid including a lid rim. The lid rim includes a lid rim flange. The embodiment container further includes a base that has a bottom and a base rim. A side wall extends upwardly from the bottom to the base rim. The side wall surrounds the bottom.

A lid rim is tuned for sealing arrangement with the base rim. A projecting portion projects outwardly in general horizontal fashion from the lid rim flange. This projecting portion is preferably integrally formed in the lid rim flange. The projecting portion includes an accordiated section connected to a pull tab. The accordiated section comprises at least one pleat. The projecting portion also includes a frangible bridge. When the plastic food container is in the initially sealed state the accordiated section has a first length and a first orientation. The frangible bridge ruptures upon the application of a first pulling force to the pull tab when the container is in the initially sealed state. To ensure that the frangible bridge ruptures before the lid is removed from the base, the first pulling force is less than the pulling force required to separate the lid from the base. When the frangible bridge ruptures, the accordiated section has a second length visibly longer than the first length, thereby showing that the container's opening mechanism has been deployed.

In the preferred embodiment the at least one pleat comprises two legs. Each leg has a top and bottom. The two legs converge at their tops to meet at a peak. As is more fully described herein, there are a variety of locations at which to place the frangible bridge of the projecting portion. In one embodiment, the projecting portion includes a shoulder and the frangible bridge connects the at least one pleat to the shoulder. In another embodiment, the lid rim includes a peripherally projecting lid rim flange and the projecting portion includes a shoulder. The frangible bridge connects the shoulder to the lid rim flange. In a preferred embodiment, the base rim includes a base rim projecting platform and when the container is in the initially sealed state the projecting portion superposes over the base rim projecting platform. In a further embodiment, wherein when the frangible bridge ruptures, the accordiated section has a second orientation.

The benefits of the inventive container can be achieved with a projecting portion having only one frangible bridge. However, for optimum balance and symmetry it is preferable that the projecting portion have a first frangible bridge and a second frangible bridge. The first frangible bridge and the second frangible bridge rupture upon the application of a first pulling force to the pull tab when the container is in the initially sealed state. The first pulling force is less than a second pulling force required to separate the lid from the base. When the first frangible bridge and the second frangible bridge rupture, the accordiated section has a second length visibly longer than the first length. The invention is also directed to the projecting portion described above, which in the preferred embodiment has two frangible bridges connecting its shoulders to the flange of the lid rim.

Notably, in the loading or initially sealed container state, the accordiated section is in fixed position relative to the shoulders of the projecting portion. In this formation, the accordiated section has a first length. The accordiated section also preferably has a first orientation, which, again, for patency purposes is most noticeable when viewed relative to both the projecting portion and the base of the container. In particular, in a preferred embodiment, the bottom of the pleat legs of the accordiated section are flush with and aligned in the same plane as the projecting portion resulting in the accordiated section having a low angle upward deviation from the base. When the base includes a projecting platform disposed underneath the projecting portion, the proximity of the projecting platform provides another visual gauge by which to discern the orientation of the pull tab and accordiated section.

Furthermore, when the lid is sealed to the base to effect the initially sealed state, the lid rim and base rim tightly engage to seal the container. In terms of sealing arrangements, the inventive container is embodied in several versions in which the lid rim and base rim engagement structures vary. In one embodiment, the lid rim flange projects into an inner wall of the base rim and is protected from access. In another embodiment, the base rim has a base rim bead that includes a bead top segment as is known in the art. In the sealed state, the lid rim flange rests atop the bead top segment of the base rim. However, the top surface of the bead top segment includes an upwardly projecting guard bead that continuously surrounds the lid rim flange except for the portion at which the projecting portion on the lid rim flange projects horizontally outwardly such that the projecting portion can sit atop the base rim bead and be grasped by a user. In another embodiment, the bead top segment includes a base rim flange. In the initially sealed state, the lid flange superposes over the base rim. The lid rim is accessible, however, because the lid rim flange is very short (effectively ungraspable without use of a gripping tool like pliers) and the rims have a very tight engagement in which the short lid flange lies flush against the base rim, there is no way to grasp the lid except by the pull tab connected to the accordiated section.

In all embodiments, the first frangible bridge and the second frangible bridge are weakened sections of plastic and thus are designed to rupture upon the application of a pulling force to the gipping tip of the pull tab when the container is in the initially sealed state. Accordingly, because the only effective way to grasp the lid when it is sealingly engaged to the base is by the pull tab, pulling on the pull tab is the only way to separate the lid from the base. However, pulling on the pull tab will cause the frangible bridges to rupture, which allows the accordiated section to expand. As the accordiated section expands, it along with the pull tab angles upwards from its original position (if not blocked by structures by the base rim as in the first embodiment hereinafter described). As shown in the figures the pull tab and accordiated section are no longer fixed and thus angle upward. That upward angular change in position also represents a different orientation with the base. This visible expansion and upward orientation of the pull tab and accordiated section provides visible indication that the container has been opened.

In contrast to the containers of Thaler and Petlak, the pull tab of the present invention container is more easily graspable as it is not surrounded by base rim structure. Also, by having an accordiated section using pleats instead of simply having ribs or grooves formed in the surface of the tab structure, the pull tab not only bends upward and changes its orientation from its fixed position, but it extends in length from that fixed position. This provides a very patent indication of the container being opened.

DETAILED DESCRIPTION

Figure 1:
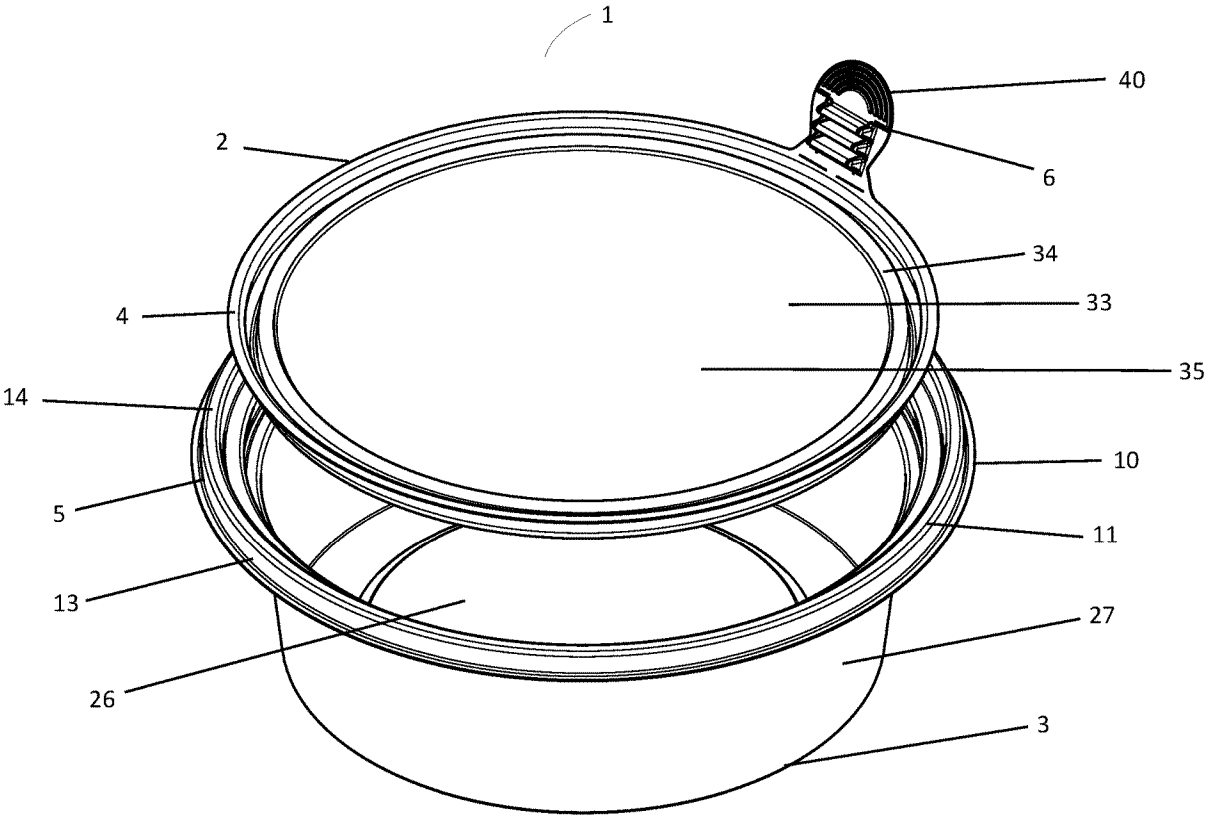
FIG. 1 is an exploded perspective view of the lid and base of a first embodiment of the present invention container in the loading state.
Figure 2:
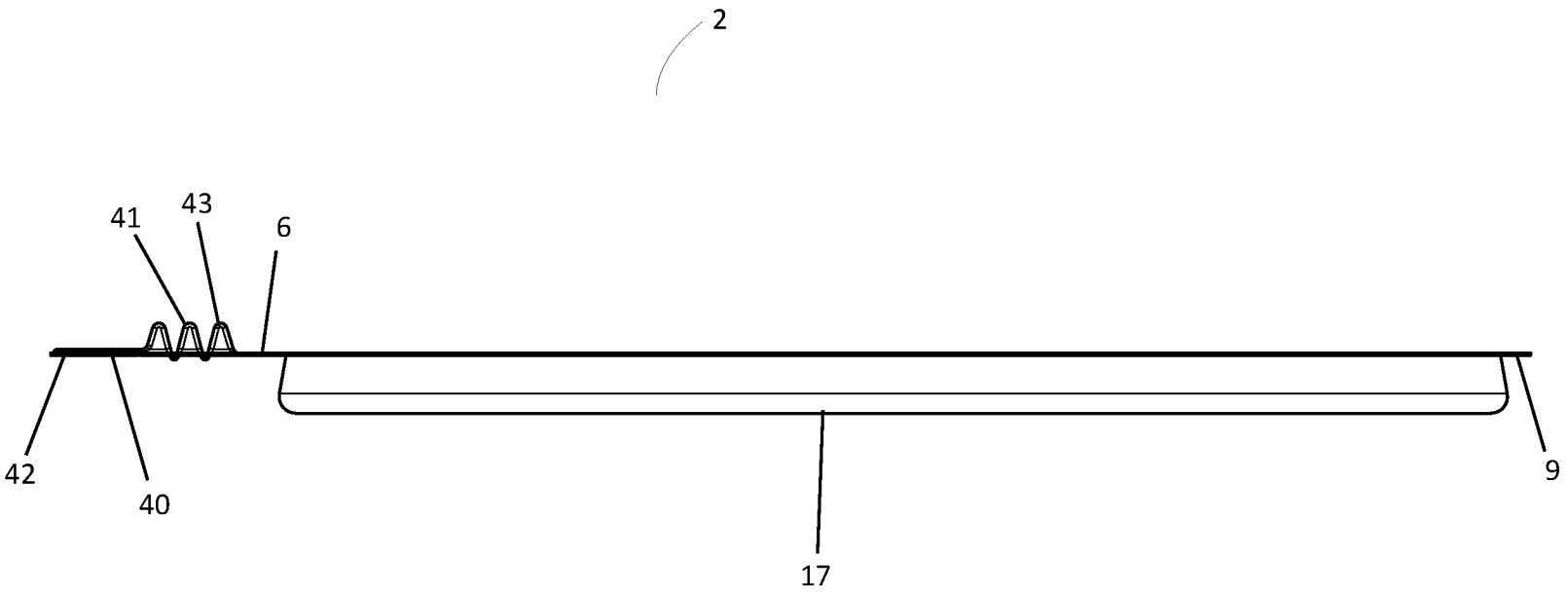
FIG. 2 is a side elevation view of the lid of the first embodiment present invention container.
Figure 3:
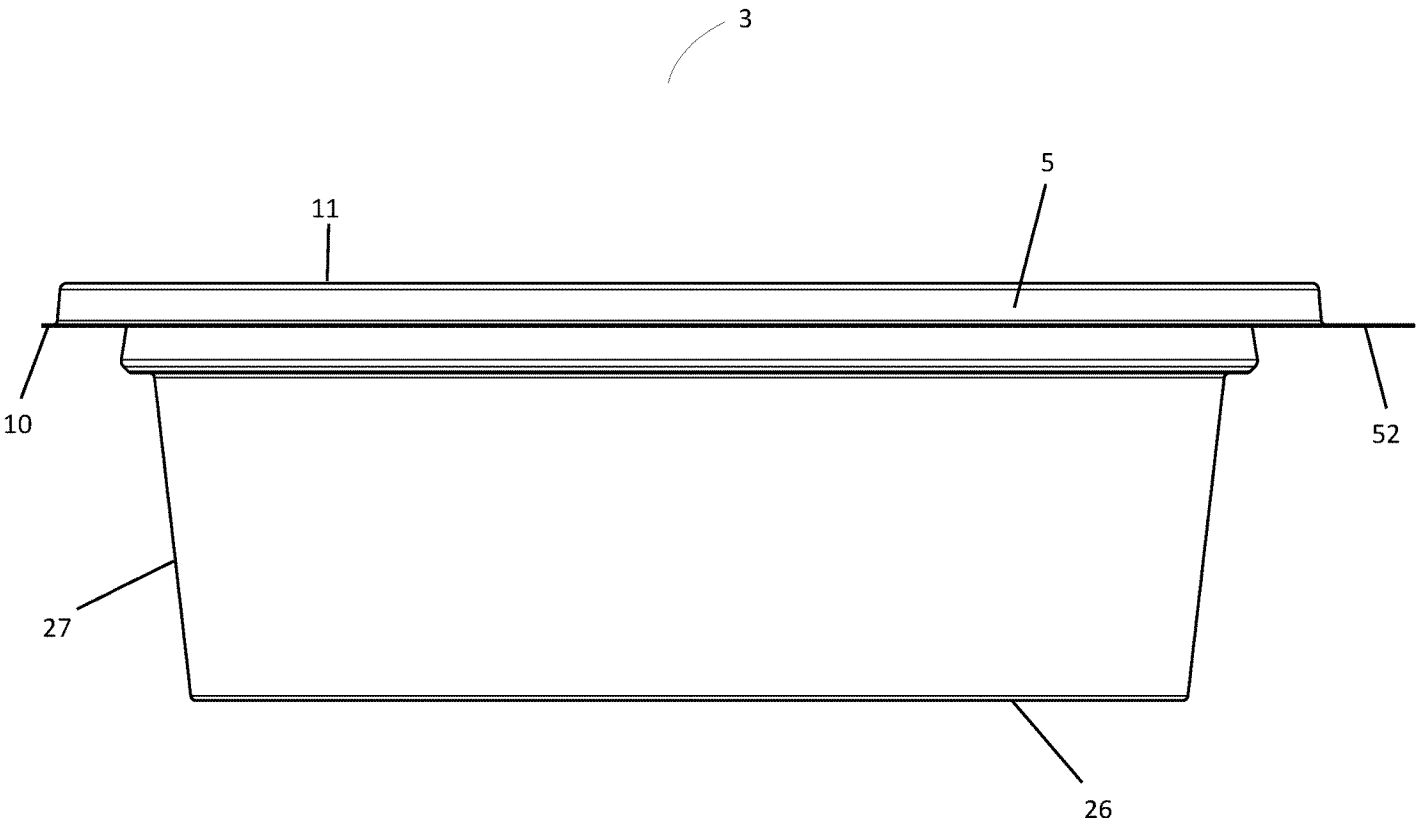
FIG. 3 is a side elevation view of the base of the first embodiment present invention container.
Figure 4:
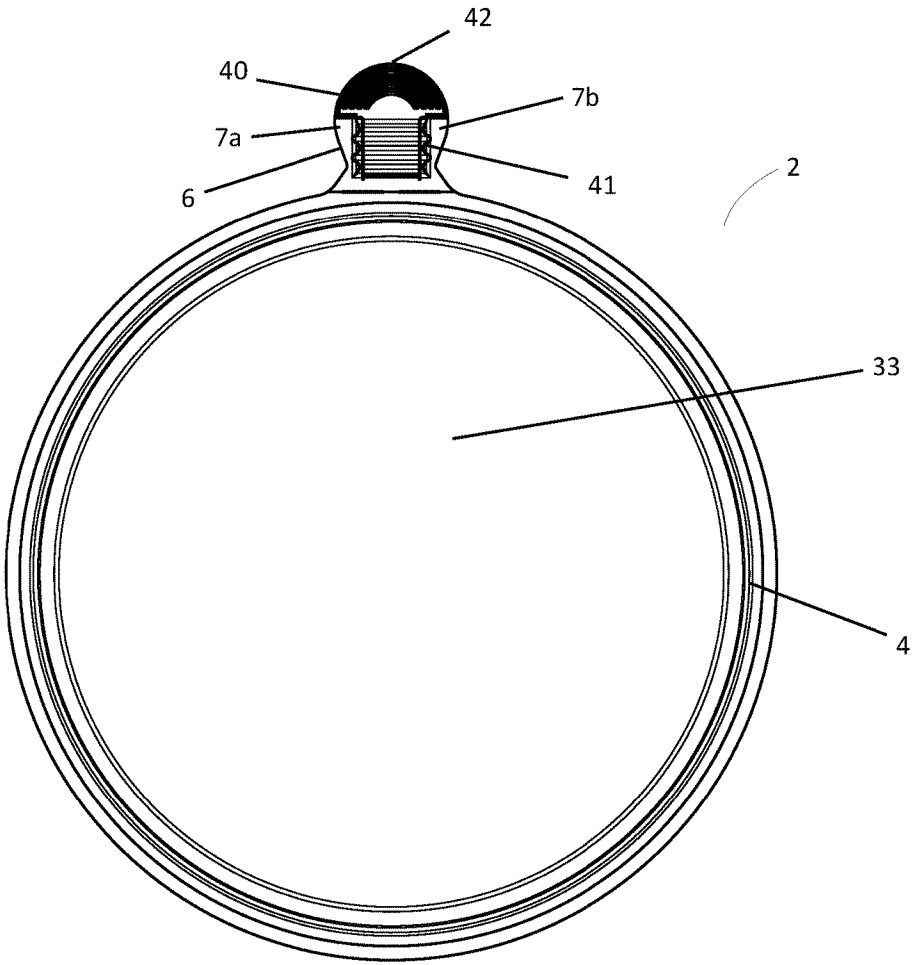
FIG. 4 is a top plan view of the lid of the first embodiment present invention container.
Figure 5:
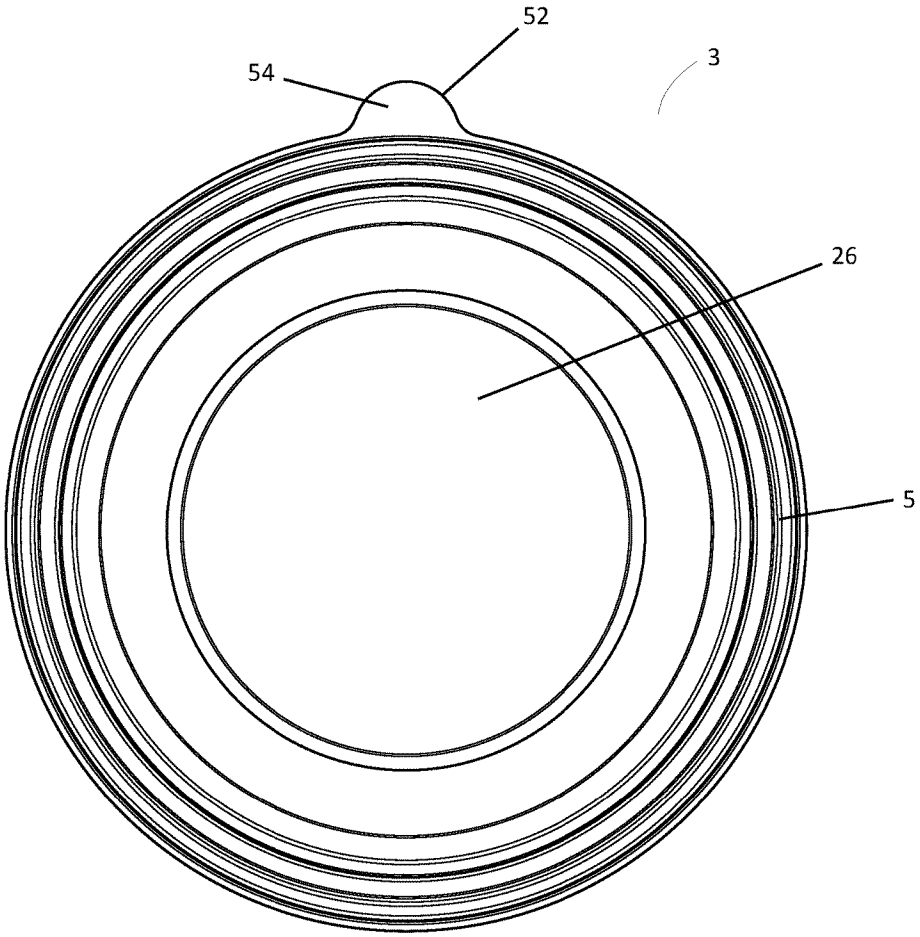
FIG. 5 is a bottom plan view of the base of the first embodiment present invention container.

FIGS. 1-35C depict preferred embodiments of a present invention tamper evident plastic container 1, 101 and 201 along with its preferred features. As is seen in the figures, the inventive container (whether in the embodiment of 1, 101 or 201) includes a lid 2 and a base 3. The inventive pull tab of the present invention can be embodied in a container that does not include a hinge as is shown in FIGS. 1-14 and 16-20. Alternatively, as is shown in FIGS. 21-34, the inventive pull tab can be part of a container 1 that includes a hinge 68 located on one side of the container. In practical use, the outer surface of floor 26 of base 3 will normally rest upon a surface (such as a table top) considered horizontal in reference to the user. Thus, the directional terms "vertical" and "horizontal" and the like are used to describe the container 1, 101 or 201 and its components with respect to the orientation illustrated in the figures and are employed merely for the purposes of clarity and illustration. The directional terms "inner" and "inwardly" and the like are used herein with respect to the described container to refer to directions along the directional component toward the geometric center of the container when the lid is sealed to the base. The directional term "outer" and the like are used herein with respect to the described container to refer to directions along the directional component away from the geometric center of the lid, base or the container when the lid is sealed to the base. The directional term "peripherally" is used herein with respect to the described container to refer to directions along the horizontal directional component away from the geometric center of the lid, base or the container when the lid is sealed to the base. Additionally, the terms "upward," "downward" and the like are used to describe spatial relationships among structure when lid 2 of container 1, 101 or 201 is sealed or closed upon the base 3. For example, FIGS. 25 through 28 show a third embodiment container 201 when container 201 is in an initially sealed state. In the orientation shown in FIGS. 25 through 28, lid 2 is vertically above base 3 and projecting portion 6 is outwardly disposed of lid rim 4.

Figure 13:
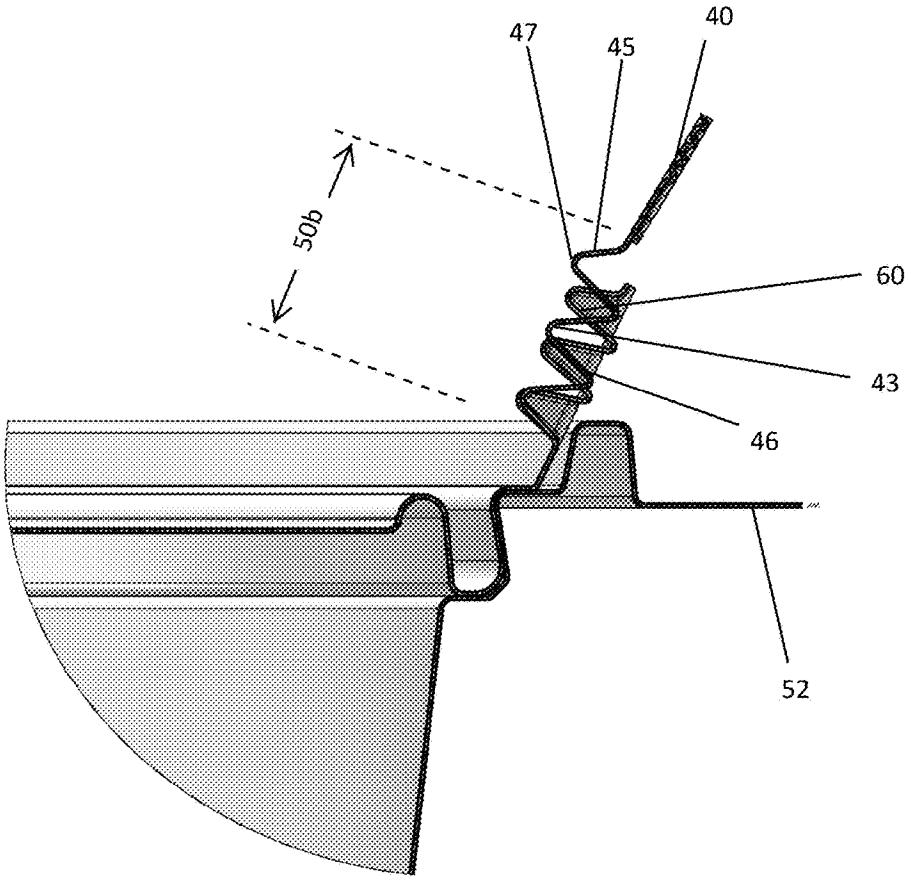
FIG. 13 is a cross section detail view of an embodiment accordiated tamper evident pull tab of the first embodiment container of the present invention showing the length of the pull tab and its positional relationship to the projecting portion of the lid rim after the pull tab has been pulled by a user in order to open the first embodiment container from the initially sealed state.
Figure 14:
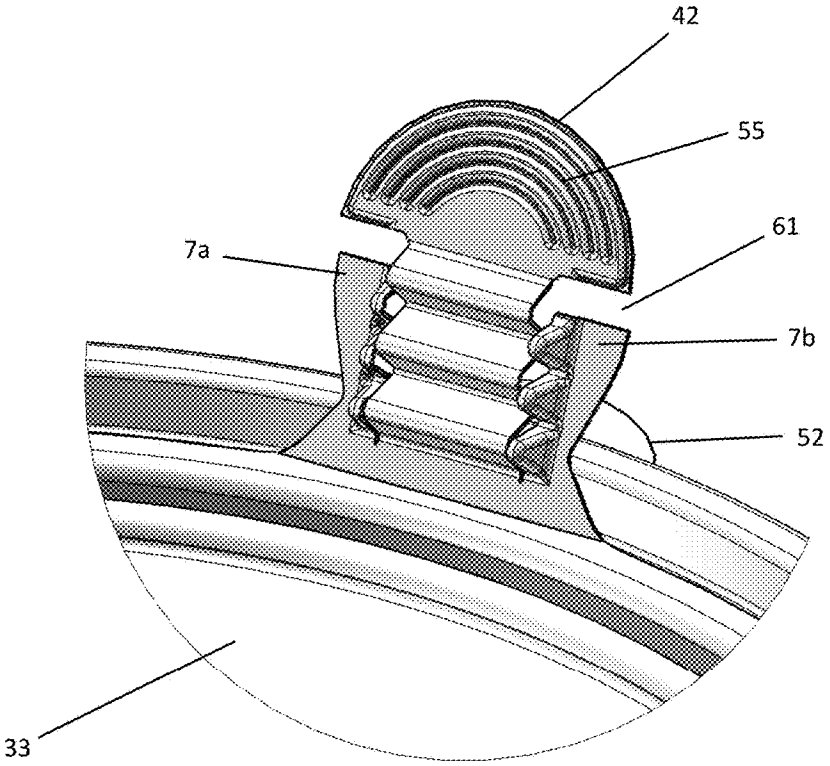
FIG. 14 is a perspective detail view of an embodiment accordiated tamper evident pull tab of the first embodiment container of the present invention showing the length of the pull tab and its positional relationship to the projecting portion of the lid rim after the pull tab has been pulled by a user in order to open the first embodiment container from the initially sealed state.

FIGS. 1-14 depict a first preferred embodiment present invention tamper evident plastic container 1. As is seen in the figures, the inventive container 1 includes a lid 2 and a base 3 that are not attached to each other through a hinge. First preferred embodiment container 1 is capable of assuming a loading state (FIG. 1), an initially sealed state (FIGS. 7-9), and an opened state or tab-employed state wherein the pull tab 40 of the projecting portion 6 has been employed. (FIGS. 13-14). Lid 2 includes lid rim 4. Lid rim 4 includes lid rim flange 9, which is preferably horizontally outwardly extending. Container 1 further includes base 3, which has bottom (floor) 26, base rim 5 and side wall 27 extending upwardly from bottom 26 to base rim 5. Side wall 27 surrounds bottom 26. Lid rim 4 is formed for sealing arrangement with base rim 5. Base rim 5 may include base rim flange 10.

As explained below, lid 2 is unsealed from base 3 through application of a sustained first pulling force to pull tab 40. Upon application of a first pulling force to pull tab 40 one or more frangible bridges 48 (numbered as 48*a*, 48*b* in the drawings) connecting pull tab 40 to projecting portion 6 are caused to break and accordiated section 41 on projecting portion 6 expands from its original state. This is shown in FIGS. 13 and 14. It is to be noted that the figures show preferred embodiment containers and projecting portions having two frangible bridges. This is merely a preferred embodiment of the invention as the invention can be effected with one frangible bridge. Continuing to pull on pull tab 40, particularly in an upward manner, results in unsealing lid 2 from base 3. Thus, container 1 and pull tab 40 can assume a tab-employed state or arrangement prior to actually opening container 1. This state is shown in FIGS. 13-14. It is to be noted that the further application of a pulling force to pull tab 40 after expansion of accordiated section 41 causes lid 2 to unseal from base 3. Additionally, container 1, after being unsealed from the initially sealed state can be re-sealed (closed). In this re-sealed state, projecting portion 6 and pull tab 40 of container 1 would appear as in FIGS. 13-14.

As seen in the figures, first embodiment container 1 comprises lid 2 and base 3. Lid 2 includes cover portion 33 and lid rim 4. Lid rim 4 circumferentially extends about the periphery of lid 2. In the preferred embodiment, lid rim 4 includes lid rim bead 17. Base 3 includes base rim 5 circumferentially extending about the periphery of base 3. Base rim 5 includes base rim bead 11 that comprises upwardly extending inner vertical wall 12, downwardly extending outer 13 and bead top segment 14. Bead top segment 14 extends from top of upwardly extending inner vertical wall 12 to top of the downwardly extending outer wall 13. Upwardly extending inner wall 12 includes an undercut surface configured (shaped and sized) to receive and frictionally engage lid rim flange 9 of lid rim 4 when container 1 is in the sealed or closed arrangement. When container 1 is in the sealed arrangement lid rim flange 9 assumes a protected position below top segment 14 of base rim bead 11.

In the context of the first embodiment container, an embodiment pull tab 40 of the present invention can be seen in FIGS. 1, 6, 7, 8 and 11-14. Container 1 includes projecting portion 6 projecting outwardly from lid 2, preferably from lid rim 4. In the preferred embodiment, projecting portion 6 is integrally formed in and projects outwardly from lid rim flange 9. Projecting portion 6 includes pull tab 40 that comprises accordiated section 41 connected to gripping tip 42. Accordiated section 41 comprises at least one pleat 43. In the depicted embodiment, pull tab 40 of container 1 has three pleats 43, but could have more or less. At least one pleat 43 preferably comprises two legs 44. Each leg 44 has a top 45 and a bottom 46. Legs 44 converge at their tops 45 to meet at peak 47.

Figure 6:
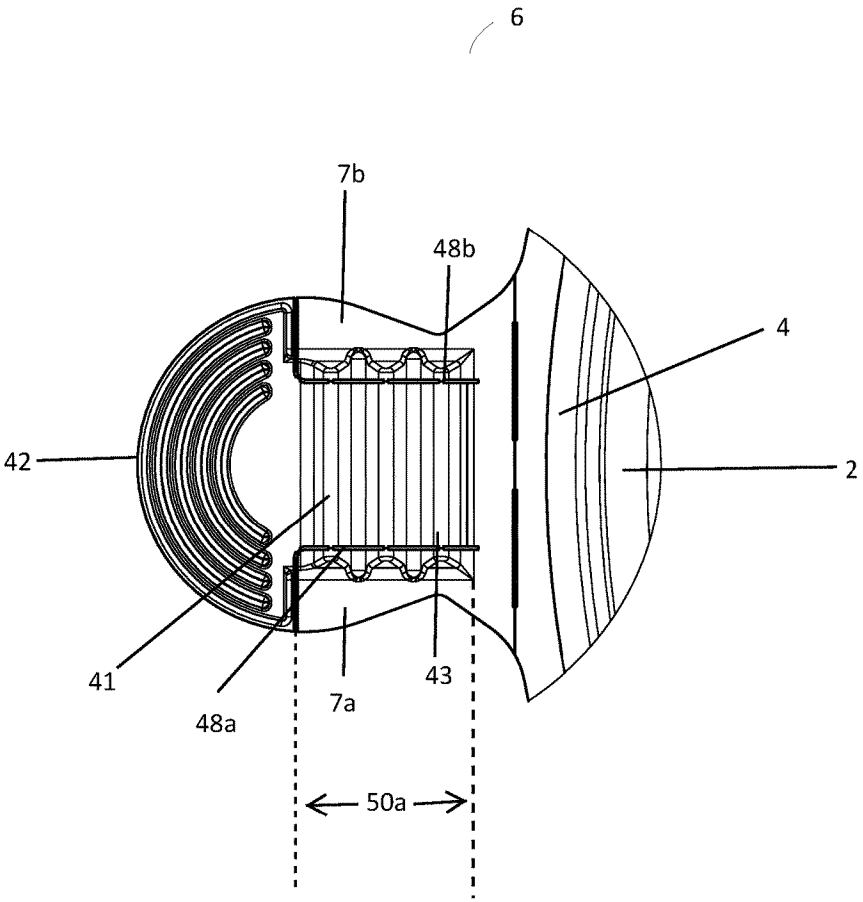
FIG. 6 is a top plan detail view of an embodiment accordiated tamper evident pull tab of the first embodiment container of the present invention showing its first length on the projecting portion when the container is in the loading state (prior to sealing of the lid to the base).
Figure 7:
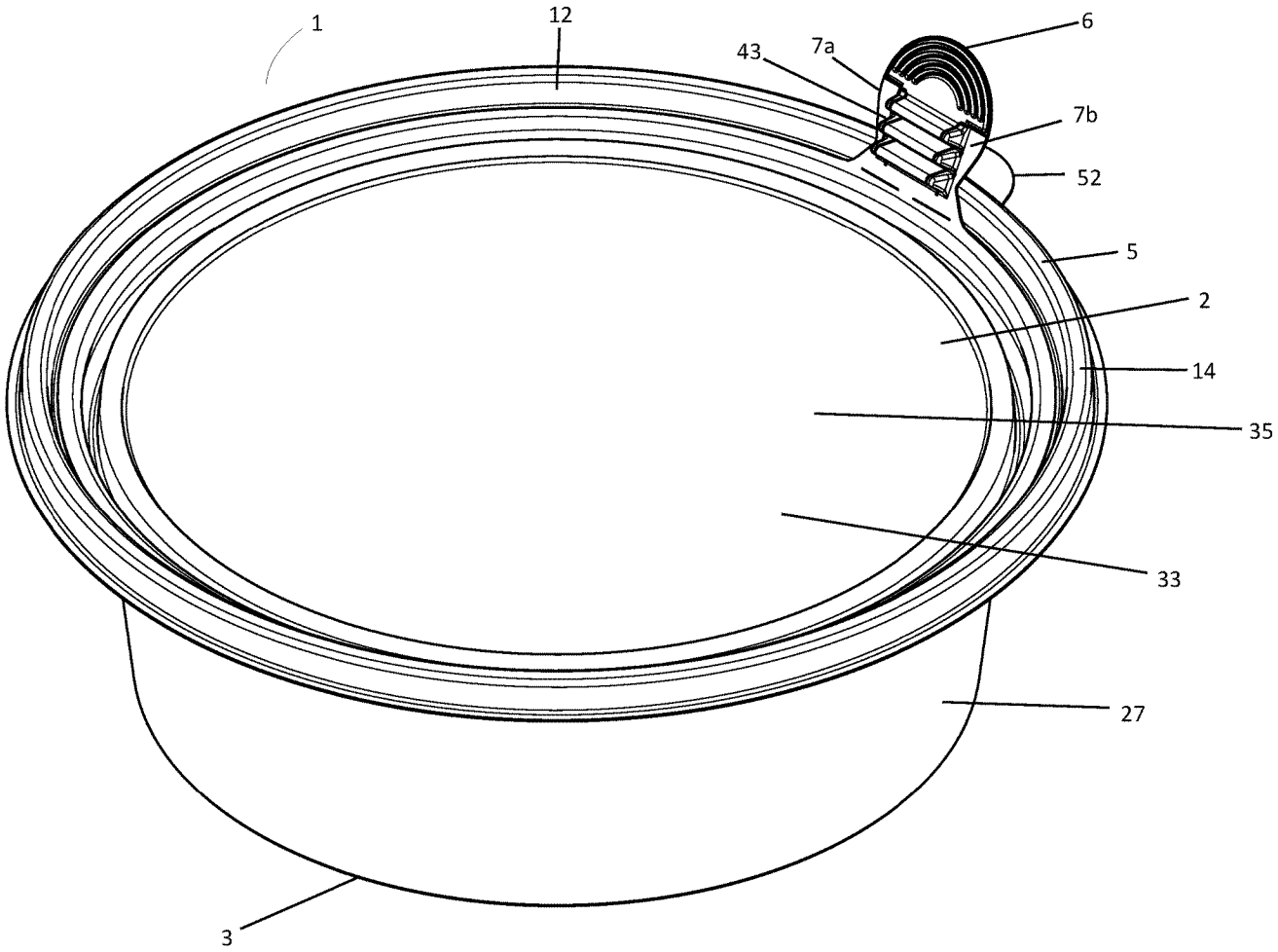
FIG. 7 is a perspective view of the first embodiment container in the initially sealed state.
Figure 8:
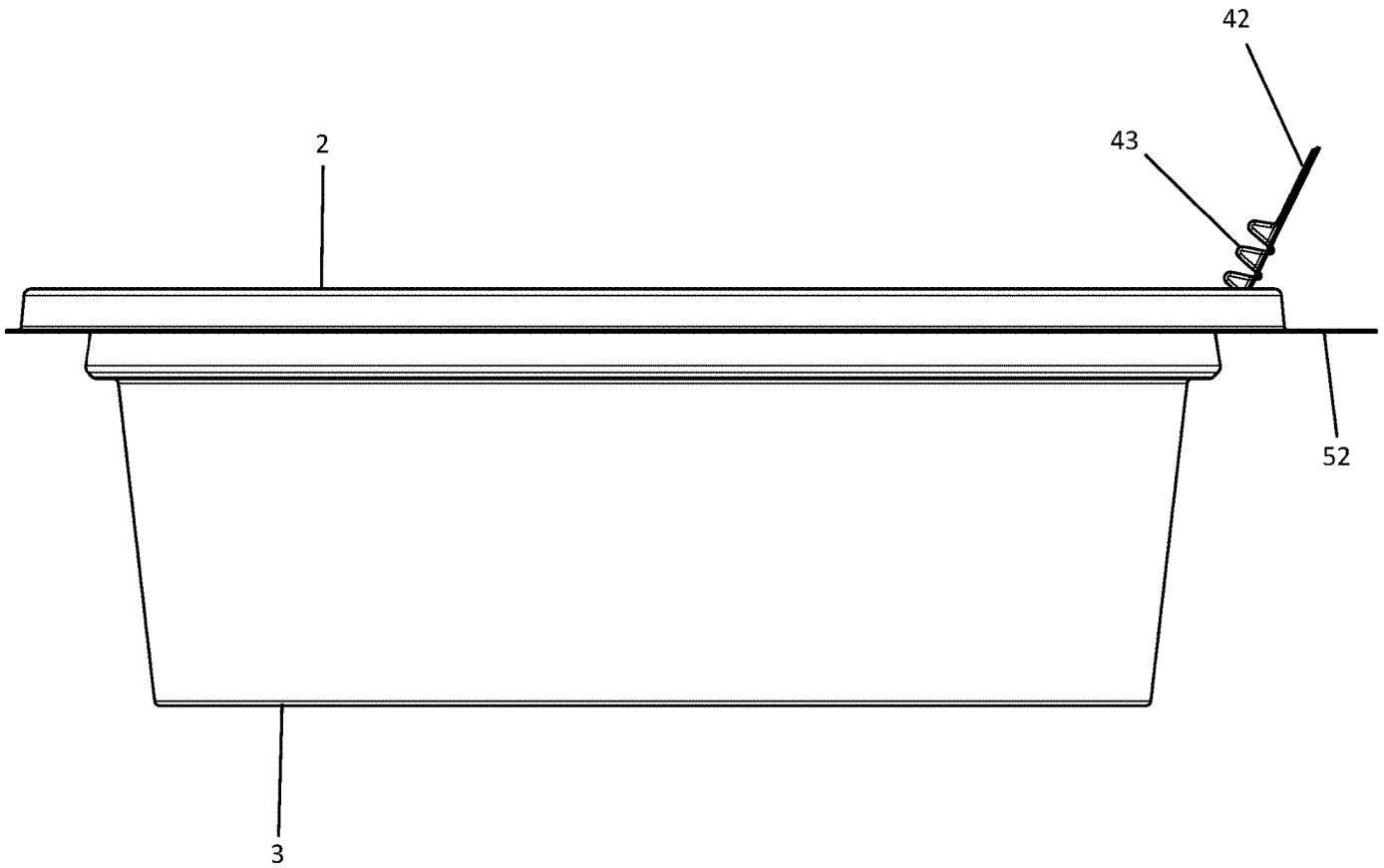
FIG. 8 is a side elevation view of the first embodiment container in the initially sealed state.
Figure 9:
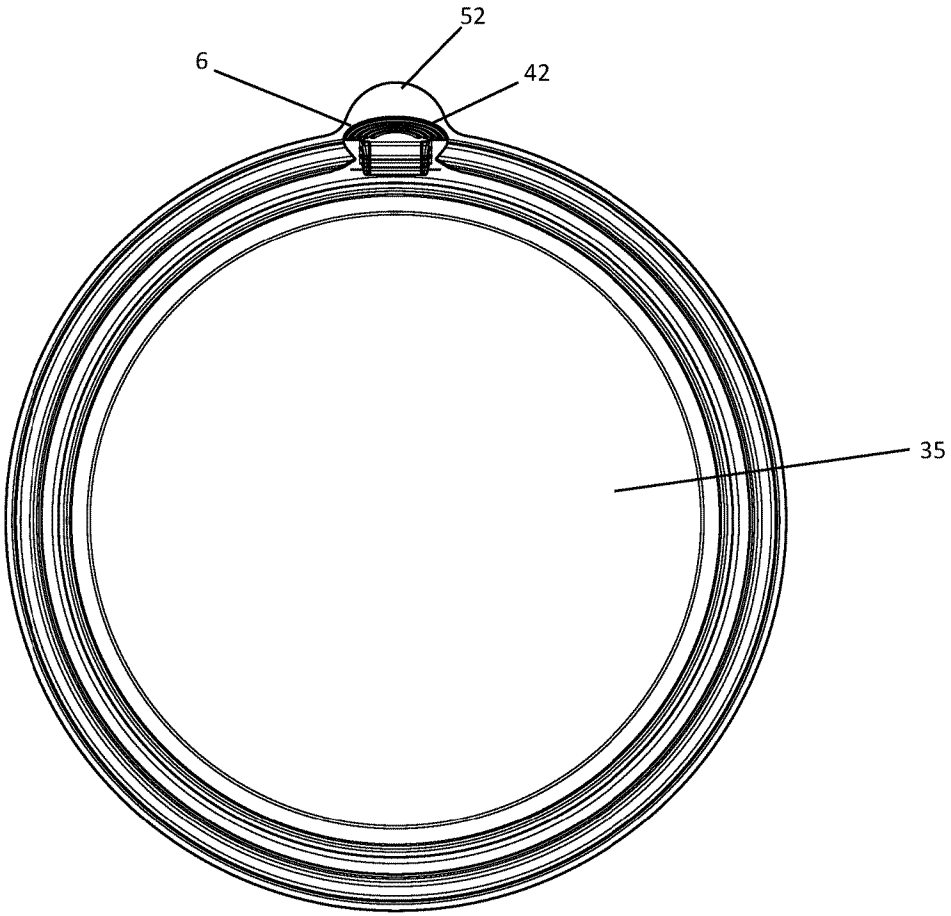
FIG. 9 is a top plan view of the first embodiment container in the initially sealed state.
Figure 10:
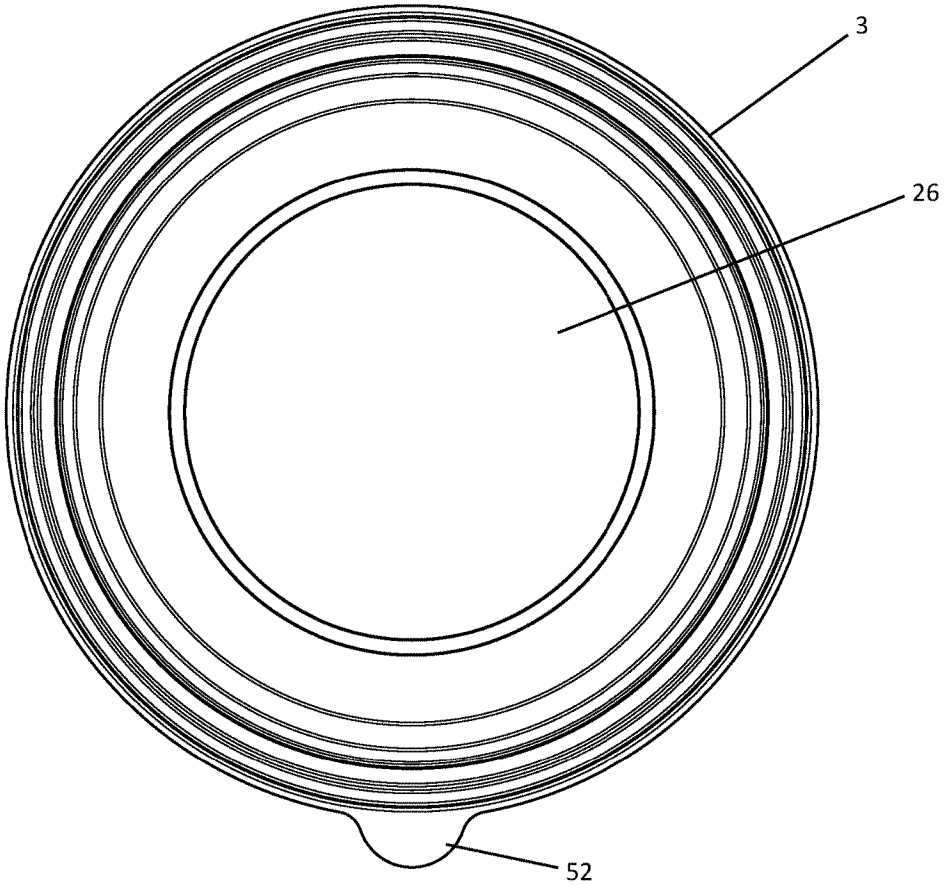
FIG. 10 is a bottom plan view of the first embodiment container in the initially sealed state.
Figure 11:
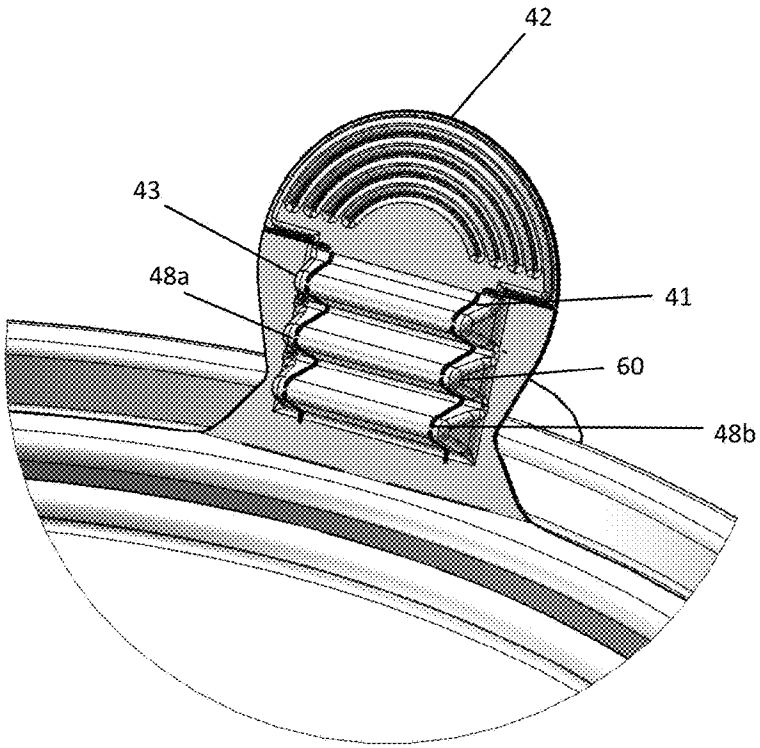
FIG. 11 is detail perspective view of an embodiment accordiated tamper evident pull tab of the first embodiment container of the present invention showing its first length and first orientation on the projecting portion when the container is in the initially sealed state (prior to being initially opened or the pull tab being deployed).
Figure 12:
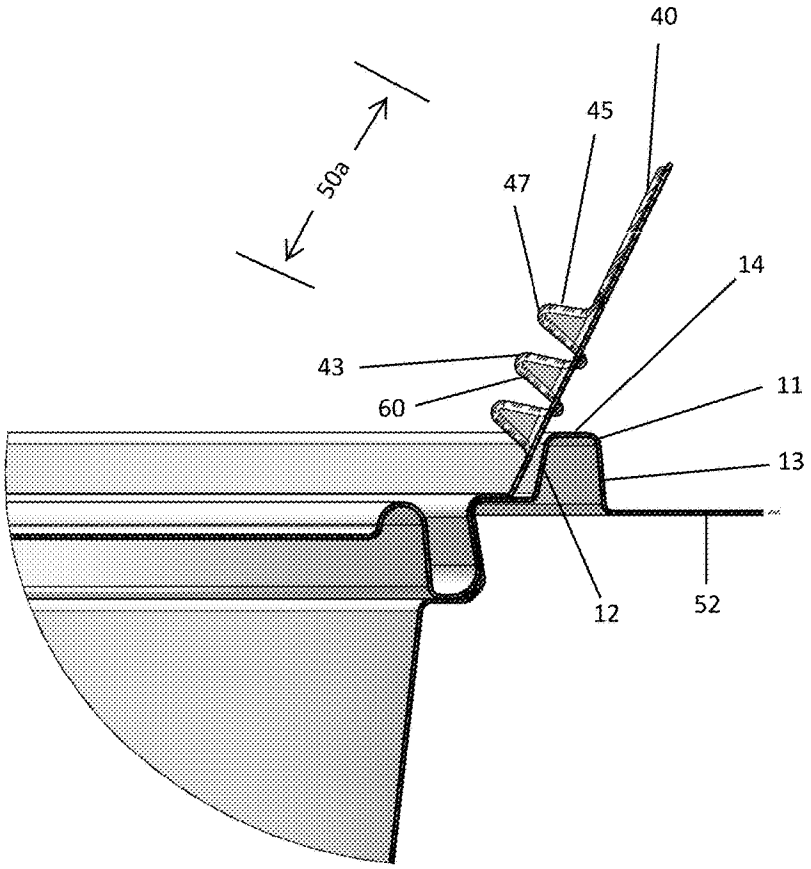
FIG. 12 is a cross section detail view of an embodiment accordiated tamper evident pull tab of the first embodiment container of the present invention showing its first length and the positional relationship of the pull tab and projecting portion of the lid rim relative to the base rim when the first embodiment of the present invention container is in the initially sealed state.

First embodiment present invention container 1 includes projecting portion 6. Projecting portion 6 includes at least one shoulder, but preferably has two shoulders 7*a*, 7*b*. FIGS. 6, 11 show a preferred embodiment projecting portion 6 in which one or more frangible bridges 48*a*, 48*b* respectively connect at least one pleat 43 to shoulders 7*a*, 7*b*. This is merely an illustrative embodiment.

When container 1 is in the loading state or the initially sealed state, accordiated section 41 has a first length 50*a*, which for visual comparison purposes can be measured relative to projecting portion 6. One or more frangible bridges 48*a*, 48*b* rupture upon the application of a pulling force to pull tab 40 when container 1 is in the initially sealed state. When one or more frangible bridges 48*a*, 48*b* rupture, accordiated section 41 has a second length 50*b* visibly different from first length 50*a*. In the exemplary embodiment shown in FIGS. 6 and 11, pleat 43 is connected to projecting portion 6 by two frangible bridges 48*a*, 48*b*.

In the embodiment shown in FIGS. 1-14, base rim 5 includes base rim projecting platform 52. Projecting portion 6 constitutes a localized planar extension of peripheral projecting lid rim flange 9. When container 1 is closed, projecting platform 52 helps protect projecting portion 6 and its integral pull tab 40 from compression damage or being inadvertently snagged. Gripping tip 42 preferably includes surface texture 55 to aid in holding gripping tip 42. In the various depicted embodiments, surface texture 55 is exemplarily shown as arcuate ribs, but could include other known textures including different shaped ribs, knurling, raised bumps or letterings as shown in the drawings.

As noted, projecting portion preferably includes two shoulders, first shoulder 7*a* and a second shoulder 7*b*. In the embodiment shown in FIGS. 1-14, first frangible bridge 48*a* connects at least one pleat 43 to first shoulder 7*a* and second frangible bridge 48*h* connects at least one pleat 43 to second shoulder 7*b*. When container 1 is in the loading state or the initially sealed state, accordiated section 41 has a first length 50*a*. When lid 2 is sealed onto base 3, projecting portion 6 is forced upward by the position of base rim bead 11. Base rim bead 11 thus contacts projecting portion 6 and causes it to angle upwardly, which makes pull tab 40 more easily graspable and give projecting portion 6 an upwardly angled orientation relative to platform 52. First and second frangible bridges 48*a*, 48*b* rupture upon the application of a pulling force to pull tab 40 when container 1 is in the initially sealed state. When frangible bridges 48*a*, 48*b* rupture, pull tab 40 is in the tab-employed state and accordiated section 41 has a second length 50*b* that is visibly different from first length 50*a*. In the preferred embodiment, lid rim 4 includes lid rim flange 9 and projecting portion 6 is integrally formed in and projects outwardly from lid rim flange 9.

The one or more frangible bridges 48*a*, 48*b* are formed as a relatively weaker material than other portions of projecting portion 6, such as pleat 43 or shoulders 7*a*, 7*b*. By virtue of being formed of weakened material, frangible bridges 48*a*, 48*b* rupture upon the application of a first pulling force to pull tab 40 when the container is in the initially sealed state that does not cause lid 2 to separate from base 3. In the depicted preferred embodiment, projecting portion 6 has two shoulders, first shoulder 7*a* and second shoulder 7*b* and pull tab 40 is interposed between shoulders 7*a*, 7*b*. In the embodiment in which bridges 48*a*, 48*b* connect to a portion of accordiated section 41, frangible bridges 48*a*, 48*b* may respectively connect to shoulders 7*a*, 7*b* directly or via a riser 60 as shown in the figures. When container 1 is in the loading state or the initially sealed state, at least one pleat 43 in accordiated section 41 is connected to projecting portion 6. In the depicted preferred embodiment this connection is achieved by a first frangible bridge 48*a* extending from pleat 43 to riser 60 on first shoulder 7*a* and by second frangible bridge 48*b* extending from pleat 43 to riser 60 on second shoulder 7*b*. When the at least one pleat 43 is connected in such fashion, pull tab 40 and accordiated section 41 has a visible first length 50*a* and a first orientation (substantially parallel) relative to projecting portion 6. In the figures showing a preferred embodiment projecting portion 6 in which accordiated section 41 has three pleats 43, each pleat 43 is thus bookended by a pair of risers 60. Risers 60 are shaped similarly to a transverse cross-section of pleats 43 in terms of kg length and the angle between legs 44. Wherever first frangible bridge 48*a* and second frangible bridge 48*b* are located, it is preferable that they be integrally formed in projecting portion 6 by thinning, scoring or skip-perforating (collectively referred to as "weakening") the plastic extending between he structures intended to separate (pleat 43 and riser 60 in the case of the embodiment shown in FIGS. 6 and 11).

As seen in the figures, projecting portion 6 and its associated accordiated section 41 deforms by operation of expansion of pleats 43 and not by operation of serration-like structures such as recesses or ribs (protrusions) formed on its surface. Accordingly, it provides a very reliable and noticeable deformation both in terms of visible difference. Plus, in terms of tactile feel when the accordiated section 41 "pops" by virtue of the rupturing of one or more frangible bridges 48*a*, 48*b*. However, being of weakened material, frangible bridges 48*a* and 48*b* rupture upon the application of a first pulling force to pull tab 40 when the container is in the initially sealed state. To break frangible bridges 48*a*, 48*b*, an outwardly directed pulling force is applied to pull tab 40 by way of grasping gripping tip 42. Notably, as shown in FIGS. 1-14, when first frangible bridge 48*a* and second frangible bridge 48*b* rupture upon the application of a first pulling force to pull tab 40, accordiated section 41 has a second length 50*b* visibly different from first length 50*a*. Also, a visible separation 61 is observable in the separated structures of pull tab 40. Application of a continued or further pulling force to pull tab 40 after rupture of frangible bridges 48*a*, 48*b* results in lid 2 separating from base 3.

The present invention is not just directed to the container shown, but more specifically to the projecting portion 6 described herein. A preferred embodiment projecting portion 6 is integrally formed in and projects outwardly from a plastic container 1. The plastic container is capable of assuming a loading state, an initially sealed state and an opened state. The container can also assume a tab-employed state in which the container lid is still sealed to the base. The projecting portion 6 comprises an accordiated section 41 connected to a pull tab 40. Accordiated section 41 comprises at least one pleat 43. Projecting portion 6 further includes at least one shoulder (shown in the embodiments as two shoulders 7*a*, 7*b*). Projecting portion 6 includes one or more frangible bridges 48*a*, 48*b*. Accordiated section 41 has a first length 50*a* when one or more frangible bridges 48*a*, 48*b* are intact. In the case of containers 101, 201 of the second and third embodiment, pull tab 40 and accordiated section 41 can also have a first orientation 51*a* when one or more frangible bridges 48*a*, 48*b* are intact. Accordiated section 41 has a second length 50*b* when one or more frangible bridges 48*a*, 48*b* are ruptured. Second length 50*b* is visibly longer and different from first length 50*a*. In the second and third embodiment containers 101, 201, pull tab 40 and accordiated section 41 also has a second orientation 51*b* when one or more frangible bridges 48*a*, 48*b* are ruptured whereby second orientation 51*b* is visibly different from first orientation 51*a*. Also, a visible separation 61 is observable in the separated structures of pull tab 40.

As in the case of container 1, a more preferred embodiment projecting portion 6 includes two shoulders, first shoulder 7*a* and a second shoulder 7*b*. It correspondingly has a first frangible bridge 48*a* and a second frangible bridge 48*b*. When the inventive container in any of its embodiments is in the loading state or the initially sealed state, accordiated section 41 has a first length 50*a* relative to projecting portion 6. Also when the inventive container in any of its embodiments is in the loading state or the initially sealed state, pull tab 40 and accordiated section 41 has a first orientation 51*a* relative to projecting portion 6. In the case of containers 101 and 201 of the second and third embodiments respectively, accordiated section 41 has a first horizontal orientation 51*a* when frangible bridges 48*a* and 48*b* are intact. First and second frangible bridges 48*a*, 48*b* rupture upon the application of a pulling force to pull tab 42 when container 1 (or 101 or 201) is in the initially sealed state. When frangible bridges 48*a*, 48*b* rupture, accordiated section 41, and thus pull tab 40, has a second length 50*b* that is visibly different from first length 50*a*. When frangible bridges 48*a*, 48*b* rupture, pull tab 40 and accordiated section 41 has a second orientation 51*b* that is different from first orientation 51*a*. In the case of the second and third embodiment containers 101, 201 the difference of the second orientation is more patent. As seen in FIGS. 16-20 and 21-34, pull tab 40 and accordiated section 41 also have a second orientation 51*b* when frangible bridges 48*a* and 48*b* are ruptured whereby second orientation 51*b* is markedly visibly different from first orientation 51*a*.

Figure 17:
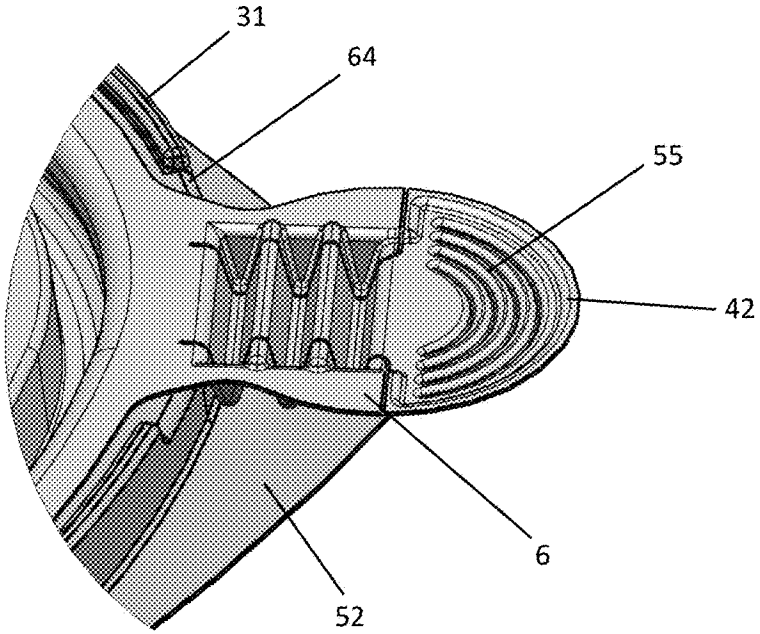
FIG. 17 is a detail perspective view showing for the second embodiment container the length of the accordiated section of the pull tab and the positional relationship of the pull tab relative to the projecting portion and the base rim when the second embodiment container is in the initially sealed state.
Figure 18:
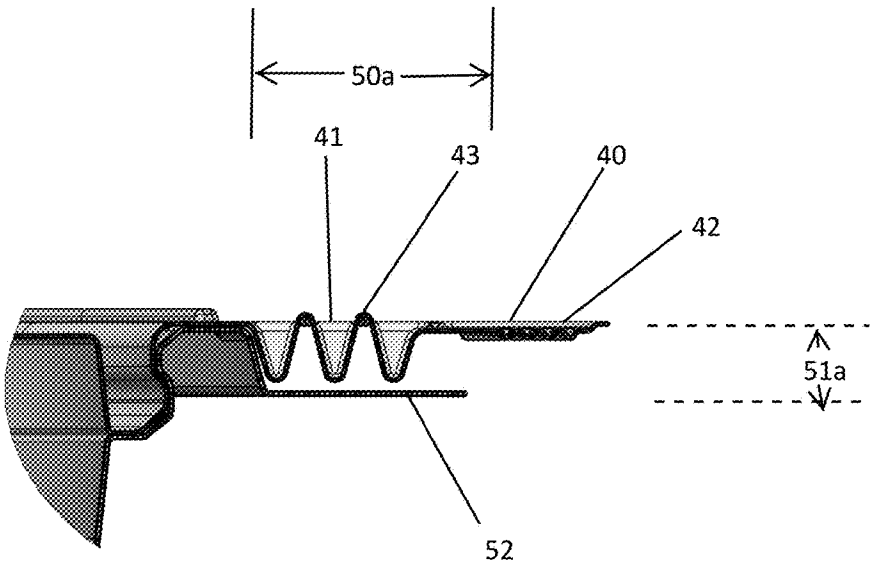
FIG. 18 is a detail section view showing for the second embodiment container the length of the accordiated section of the pull tab and the positional relationship of the pull tab relative to the projecting portion and the base rim when the second embodiment container is in the initially sealed state.
Figure 19:
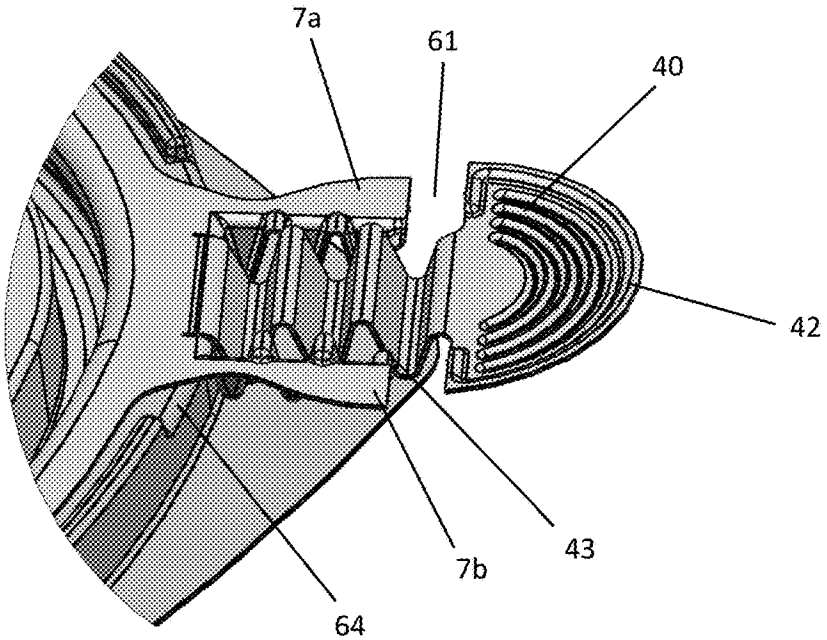
FIG. 19 is a detail perspective view showing for the second embodiment container the length of the accordiated section of the pull tab and the positional relationship of the pull tab relative to the projecting portion and the base rim after the pull tab has been pulled to open the second embodiment container from the initially sealed state.
Figure 20:
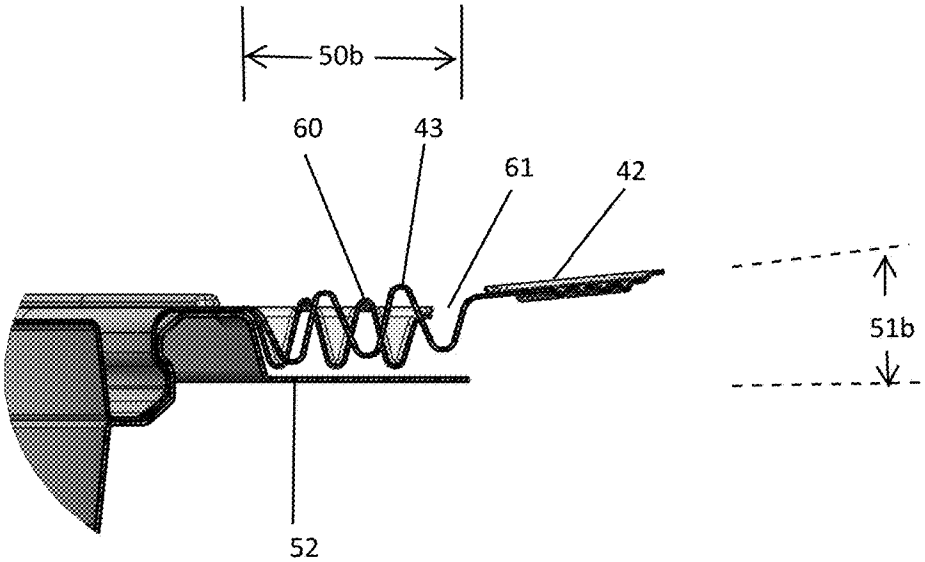
FIG. 20 is a detail section view showing for the second embodiment container the length of the accordiated section of the pull tab and the positional relationship of the pull tab relative to the projecting portion and the base rim after the pull tab has been pulled to open the second embodiment container from the initially sealed state.
Figure 21:
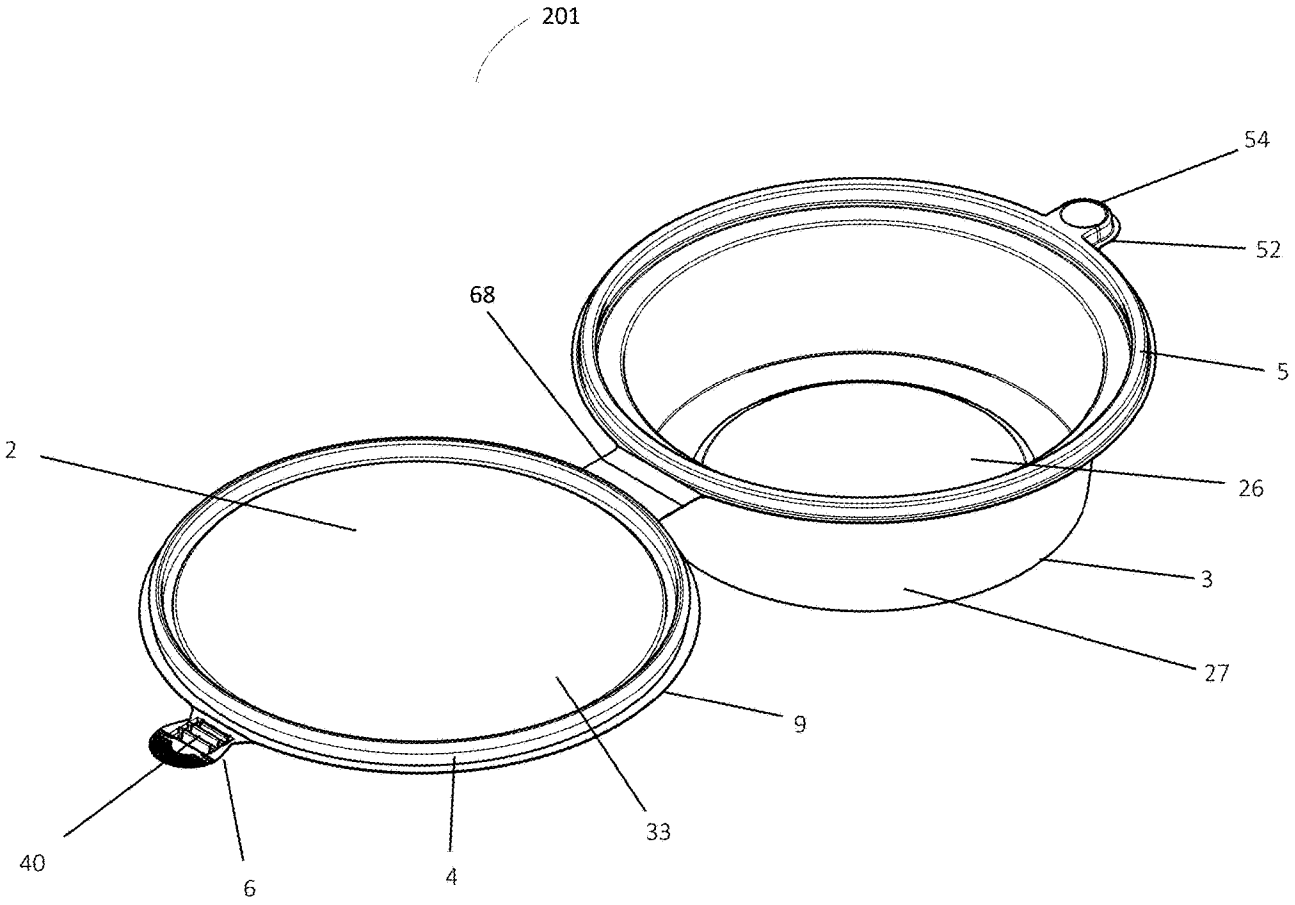
FIG. 21 is a perspective view of a third embodiment of the present invention container in the loading state.
Figure 22:
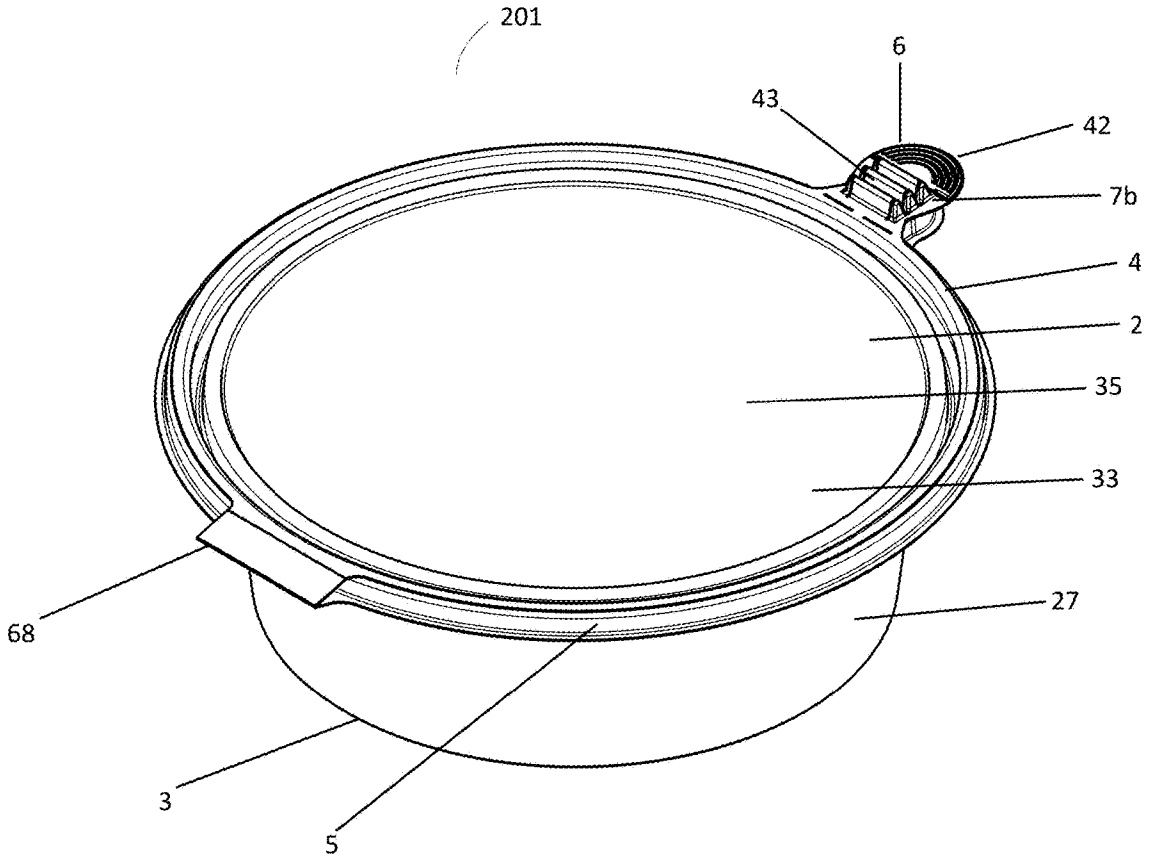
FIG. 22 is a perspective view of a third embodiment of the present invention container in the initially sealed state.
Figure 23:
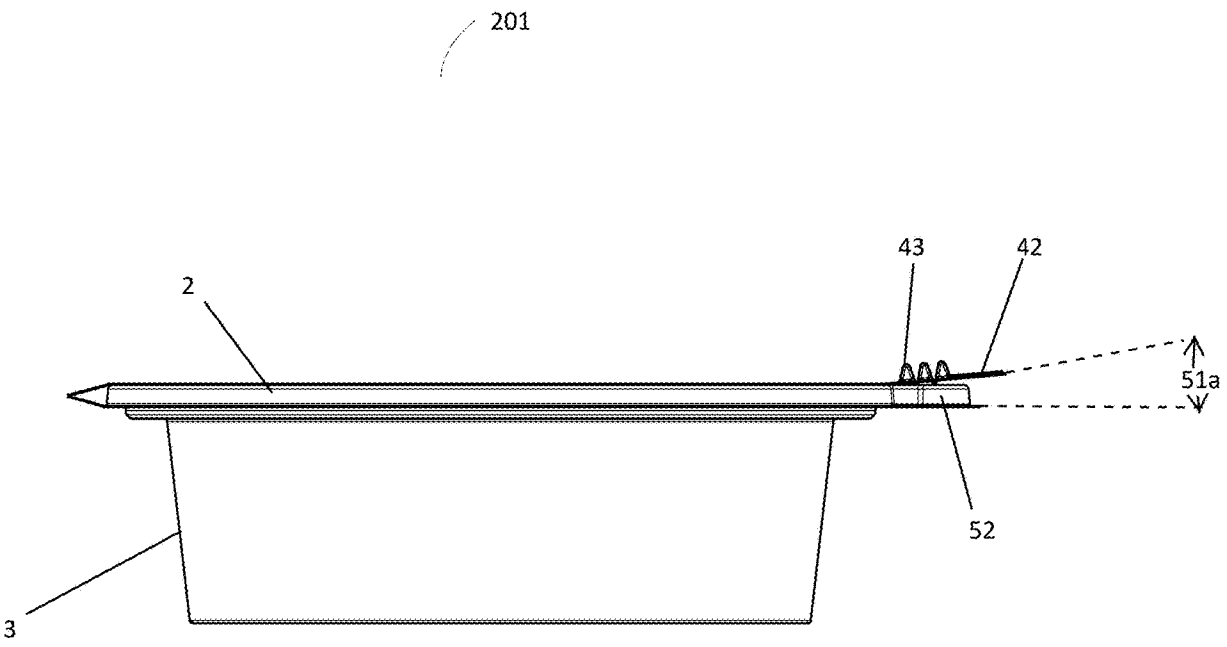
FIG. 23 is a side elevation view of the third embodiment present invention container the initially sealed state.
Figure 24:
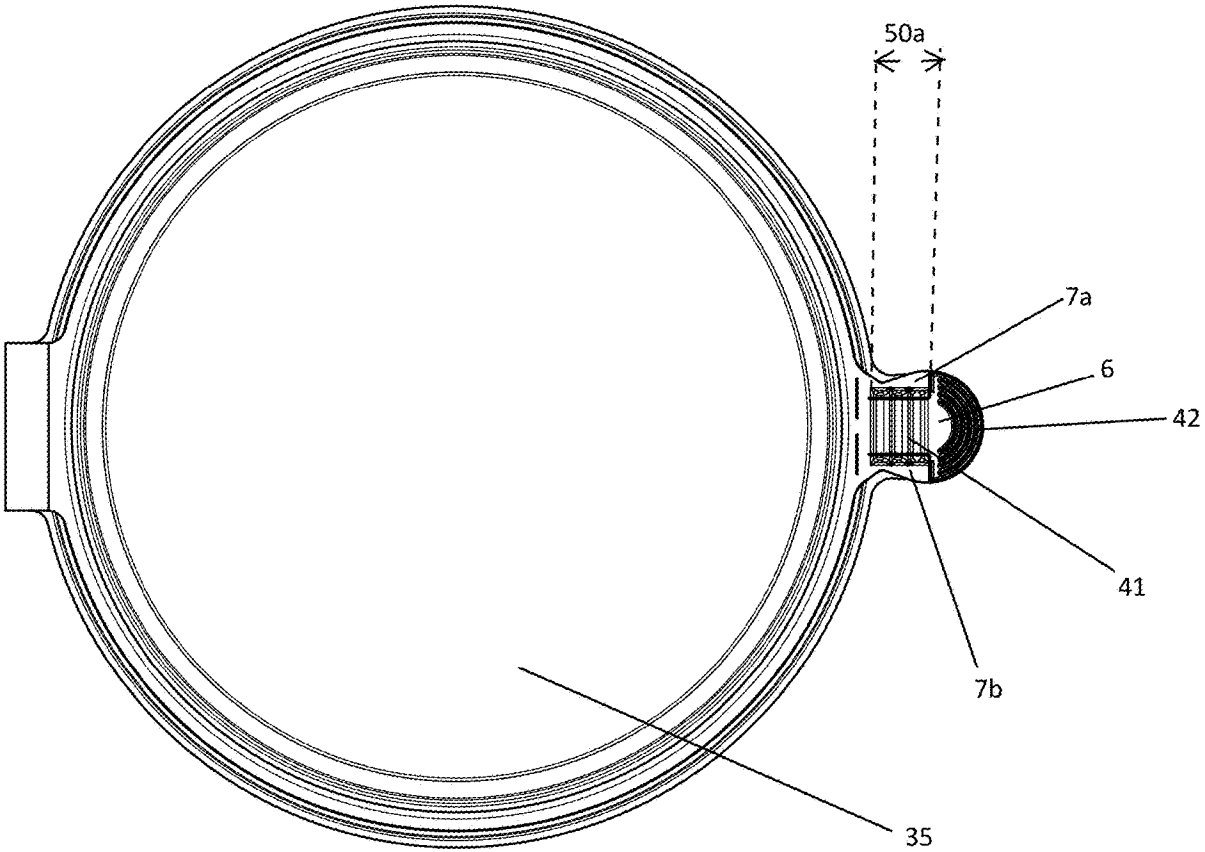
FIG. 24 is a top plan view of the third embodiment present invention container in the initially sealed state.
Figure 25:
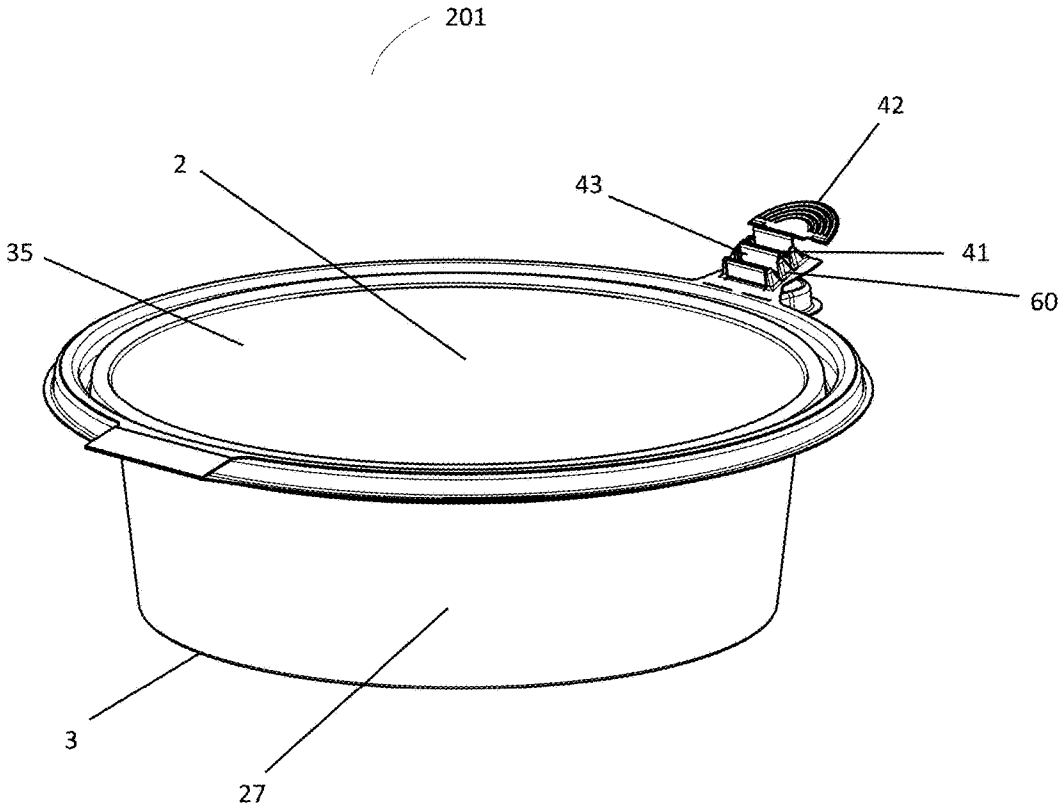
FIG. 25 is a detail perspective view of the third embodiment container when the third embodiment container is in the initially sealed, but pull tab-employed (pulled), state.
Figure 26:
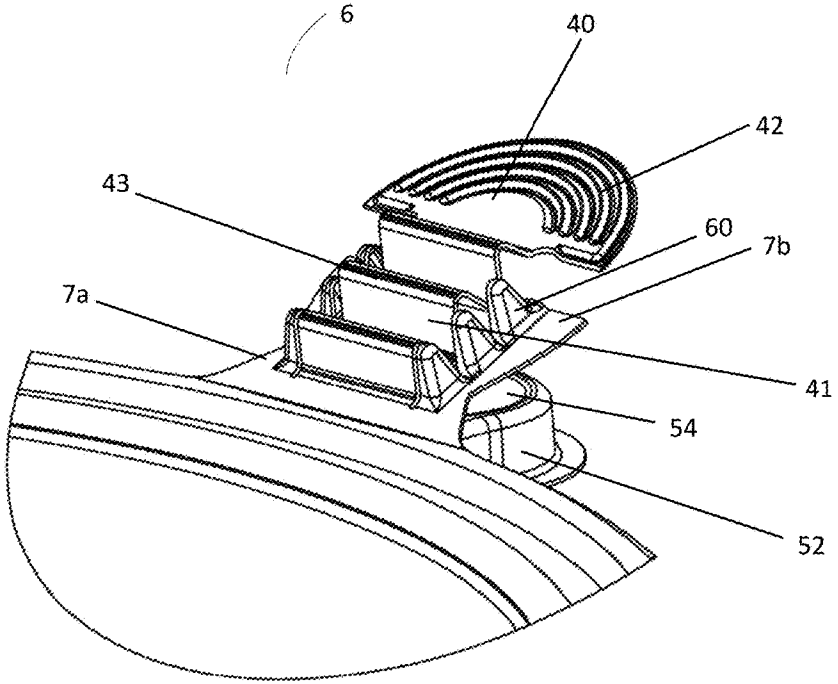
FIG. 26 is a detail perspective view showing for the third embodiment container the length of the pull tab of the projecting portion and the positional relationship of the pull tab relative to the projecting portion and the base rim when the projecting portion has been pulled to open the third embodiment container, the container still remaining in the initially sealed state.
Figure 27:
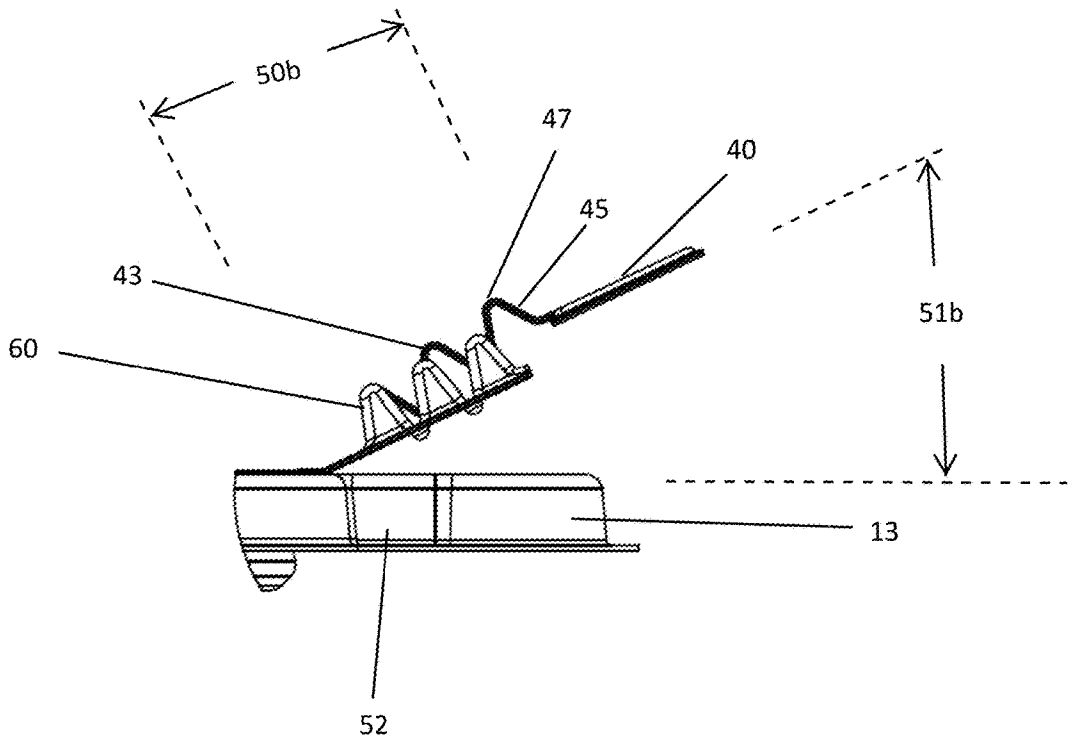
FIG. 27 is a detail side elevation view showing for the third embodiment container the length of the pull tab of the projecting portion and the positional relationship of the pull tab relative to the projecting portion and the base rim when the projecting portion has been pulled to open the third embodiment container, the container still remaining in the initially sealed state.
Figure 28:
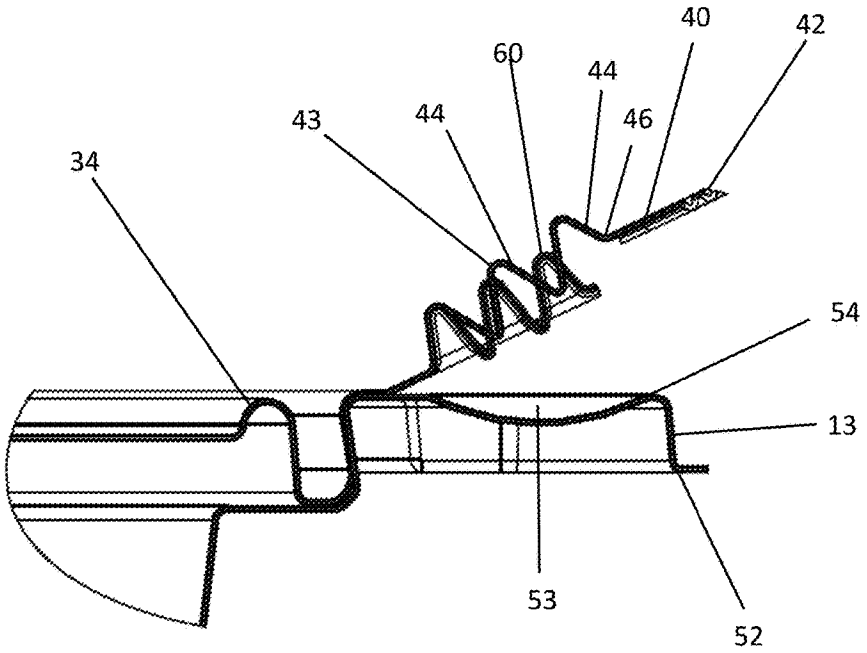
FIG. 28 is a detail section view showing for the third embodiment container the length of the pull tab of the projecting portion and the positional relationship of the pull tab relative to the projecting portion and the base rim when the projecting portion has been pulled to open the third embodiment container, the container still remaining in the initially sealed state.
Figure 29:
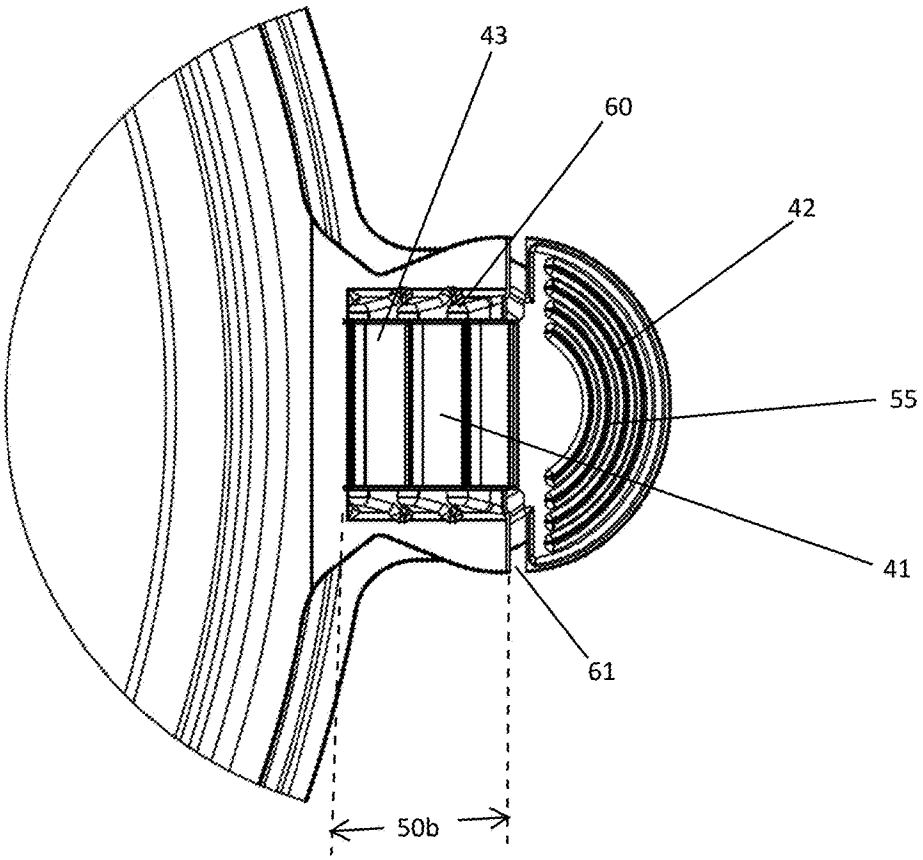
FIG. 29 is a detail top plan view showing for the third embodiment container the length of the pull tab of the projecting portion and the positional relationship of the Pull tab relative to the projecting portion and the base rim when the projecting portion has been pulled to open the third embodiment container, the container still remaining in the initially sealed state.
Figure 30:
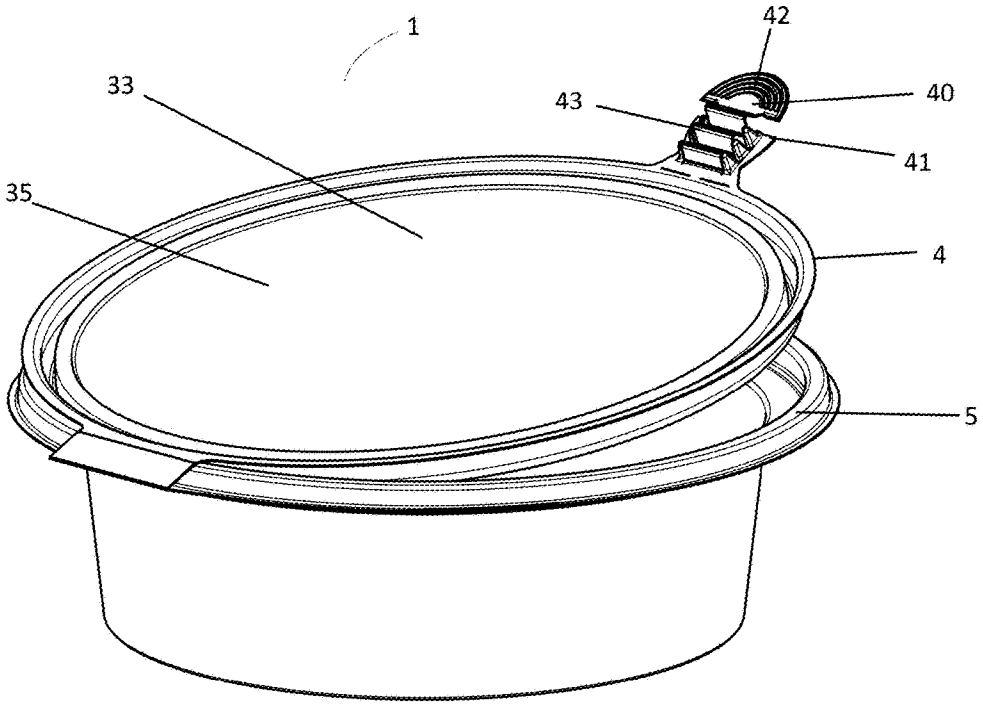
FIG. 30 is a perspective view of the third preferred embodiment container wherein the accordiated pull tab of the present invention has been employed to separate the lid from the base of the container and thereby open the container from the initially sealed state.

FIGS. 16-20 depict a second preferred embodiment present invention tamper evident plastic container 101 along with its preferred features. As is seen in the figures, the inventive container 101 includes a lid 2 and a base 3. Second preferred embodiment container 101 is capable of assuming a loading state (FIG. 16), an initially sealed state (in which its projecting portion is disposed as is shown in FIGS. 17 and 18), a tab-employed state (in which the pull tab portion is disposed as is shown in FIGS. 19-20. Continuing to pull on pull tab 40 after the container is in the tab-employed state operates to remove the lid from the base and place the container in an opened state. Lid 2 includes lid rim 4. Lid rim 4 includes lid rim flange 9, which is preferably horizontally outwardly extending. Container 101 further includes base 3, which has bottom (floor) 26, base rim 5 and side wall 27 extending upwardly from bottom 26 to base rim 5. Side wall 27 surrounds bottom 26. Lid rim 4 is formed for sealing arrangement with base rim 5.

As explained below, after one or more frangible bridges 48*a*, 48*b* rupture, lid 2 is unsealed from base 3 through continued or further application of a pulling force to pull tab 40. Upon application of a first pulling force to pull tab 40 one or more frangible bridges 48*a*, 48*b* connecting pull tab 40 to projecting portion 6 are caused to break. Continuing to pull or applying a discrete second pulling force on pull tab 40, (i.e., further application of a pulling force to pull tab 40) particularly in an upward manner, results in unsealing lid 2 from base 3. Thus, container 101 and pull tab 40 can assume a tab-employed state or arrangement prior to actually opening container 101. This state is shown in FIGS. 19-20. Additionally, container 201, after being unsealed from the initially sealed state can be re-sealed (closed). In this re-sealed state, container 201 would also appear as in FIGS. 19-20.

As seen in the figures, second embodiment container 101 comprises lid 2 and base 3. Lid 2 includes cover portion 33 and lid rim 4. Lid rim 4 circumferentially extends about the periphery of lid 2. The overall rim structural features that make the second embodiment container not just tamper evident, but also tamper resistant are similar to those shown in FIG. 15 and are described infra with respect to the third embodiment container. However, in the case of the second embodiment container, bead top segment 14 includes an upwardly projecting guard bead 31. Guard bead 31 peripherally and continuously extends atop base rim bead 11 except for one gap (a discontinuity) 64 sized to allow projecting portion 6 to extend there through when the container is in the sealed state. Guard bead 31 thus serves as a barrier to accessing lid rim flange 9 when container 101 is in the sealed state.

The inventive pull tab 40 of the second embodiment container is identical to that of the first embodiment container and the frangible bridge or bridges can be located as is described above and shown in FIGS. 6, 11 and 35A-35C. By virtue of the rim structures utilized in the second embodiment container 101, projecting portion 6 is not biased and held at an upward angle relative to base rim 5 as in the case of container 1. This different rim structure allows not just the length of projecting portion 6 to provide a visible indicator of the pull tab 40 being employed, but also its orientation. In this respect, when container 101 is in the loading state or the initially sealed state, accordiated section 41 has a first length 50*a*, which for visual comparison purposes can be measured relative to projecting portion 6. Accordiated section 41 also preferably has a first orientation 51*a*, which for discernment purposes can be more easily seen relative to projecting portion 6 and platform 52 of base 3. One or more frangible bridges 48*a*, 48*b* rupture upon the application of a pulling force to pull tab 40 when container 101 is in the initially sealed state. When frangible bridges 48*a*, 48*b* rupture, accordiated section 41 has a second length 50*b* visibly different from first length 50*a*. As explained above, projecting portion 6 preferably has two frangible bridges 48*a*, 48*b*, but the invention can be practiced with only one bridge.

In the second embodiment, base rim 5 includes base rim projecting platform 52. When container 101 is in the initially sealed state, projecting portion 6 superposes over base rim projecting platform 52. Thus, when container 201 is closed, projecting platform 52 helps protect projecting portion 6 and its integral pull tab 40 from compression damage or being inadvertently snagged. Gripping tip 42 preferably includes surface texture 55 to aid in holding gripping tip 42. Platform 52 also serves to provide a visible reference for the orientation of projecting portion 6 both before and after activation of pull tab 40. In this respect, accordiated section can also be formed with a strong memory such that the rupturing of one or more frangible bridges 48*a*, 48*b* causes projecting portion 6 to have a second orientation 51*b* visibly different from first orientation 51*a*. As used herein, the term "orientation" in reference to projecting portion 6 means its orientation relative to the angle of position of projecting platform 6. In the case of second embodiment container 101, the orientation of projecting platform 6 is generally horizontal and aligned with platform 52 projecting from base rim 5. Platform 52 thus serves to emphasize and delineate the orientation of pull tab 40. Thus, when frangible bridge 48*a* ruptures, the memory in accordiated section 41 causes at least pull tab 40 to angle upward and increase distance from platform 52. Thus, in addition to changing the length of the accordiated section and the pull tab, the rupturing of one or more frangible bridges 48*a*, 48*b* also preferably causes pull tab 40 to visibly change orientation from first orientation 51*a* to second orientation 51*b* as shown in FIGS. 19-20. In the preferred embodiment, lid rim 4 includes lid rim flange 9 and projecting portion 6 is integrally formed in and projects outwardly from lid rim flange 9.

As seen in FIGS. 16-20, pull tab 40 and its associated accordiated section 41 deforms (extends) by operation of expansion of pleats 43 and not by operation of serration-like structures such as recesses or ribs (protrusions) formed on its surface. Accordingly, it provides a very reliable and noticeable deformation both in terms of visible difference, plus in terms of tactile feel when the accordiated section 41 "pops" by virtue of the rupturing of frangible bridges 48*a*, 48*b*. However, being of weakened material, frangible bridges 48*a* and 48*b* rupture upon the application of a first pulling force to pull tab 40 when the container 101 is in the initially sealed state. To break frangible bridges 48*a*, 48*b*, an outwardly directed pulling force is applied to pull tab 40 by way of grasping gripping tip 42. Notably, as shown in FIGS. 16-20, when first frangible bridge 48*a* and second frangible bridge 48*b* rupture upon the application of a pulling force to pull tab 40, pull tab 40 and accordiated section 41 have a second length 50*b* visibly different from first length 50*a*. In the preferred embodiment, a second orientation 51*b* is visibly different from first orientation 51*a*. In the preferred embodiment, second orientation 51*b* is visibly angled upward from projecting portion 6 in relation to its previous parallel or flush position with projecting portion 6 due to being fixed by frangible bridges 48*a*, 48*b*.

FIGS. 21-36 depict a third preferred embodiment present invention tamper evident plastic container 201 along with its preferred features. As is seen in the figures, the inventive container 201 includes a lid 2 and a base 3 attached to each other through a hinge 68 located on one side of the container when sealed. The third embodiment container includes the inventive projecting portion described with reference to the second embodiment container or shown in the figures.

Figure 31:
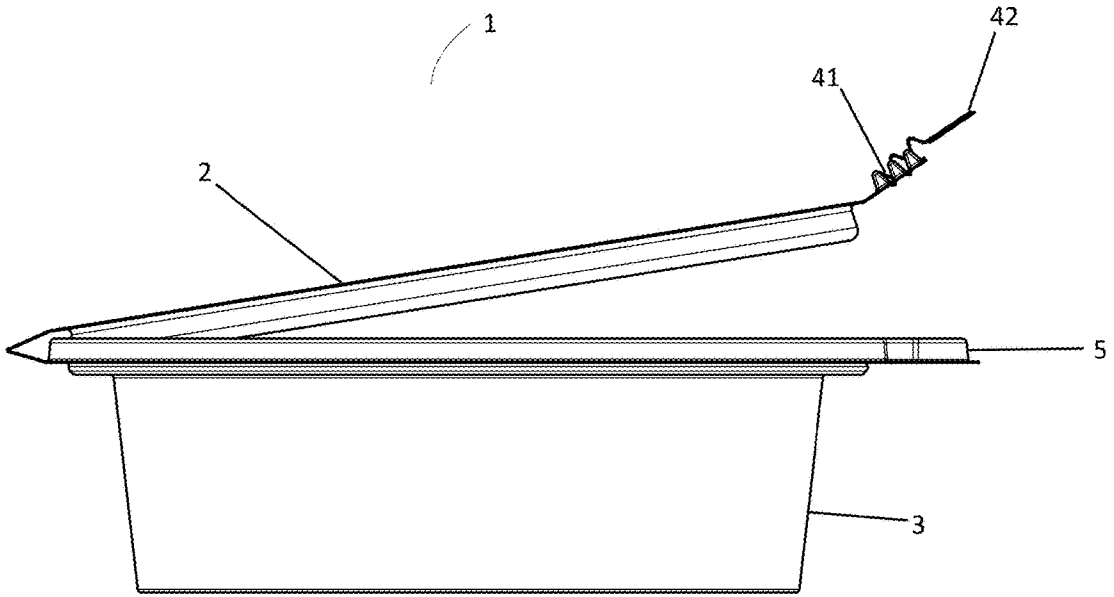
FIG. 31 is a side elevation view of the third preferred embodiment container wherein the accordiated pull tab of the present invention has been employed to separate the lid from the base of the container and thereby open the container from the initially sealed state.
Figure 32:
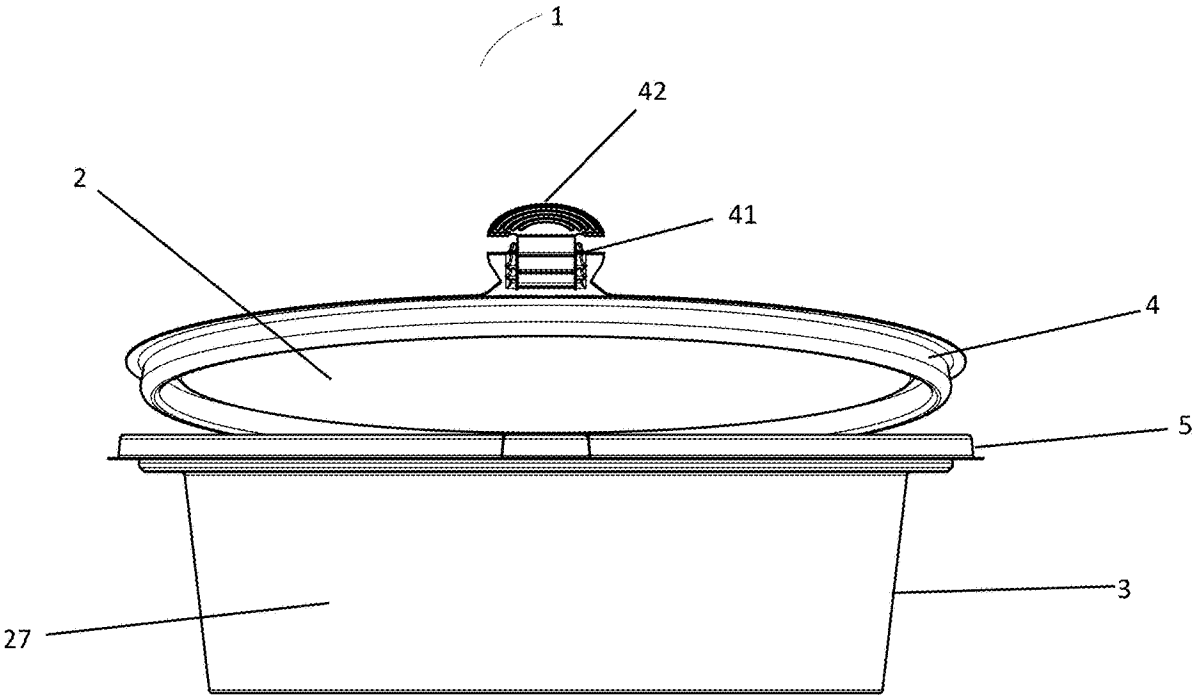
FIG. 32 is a front elevation view of the third preferred embodiment container wherein the accordiated pull tab of the present invention has been employed to separate the lid from the base of the container and thereby open the container from the initially sealed state.

As shown FIGS. 21-34, third preferred embodiment container 201 is capable of assuming a loading state (FIGS. 21-24), an initially sealed state (FIGS. 25-28), a tab-employed state (FIGS. 33-34) in which the container may still remain sealed or be opened and an opened state (FIGS. 31, 32). Lid 2 includes lid rim 4. Lid rim 4 includes lid rim flange 9, which is preferably horizontally outwardly extending. Container 201 further includes base 3, which has bottom (floor) 26, base rim 5 and side wall 27 extending upwardly from bottom 26 to base rim 5. Side wall 27 surrounds bottom 26. Lid rim is formed for sealing arrangement with base rim 5.

Figure 33:
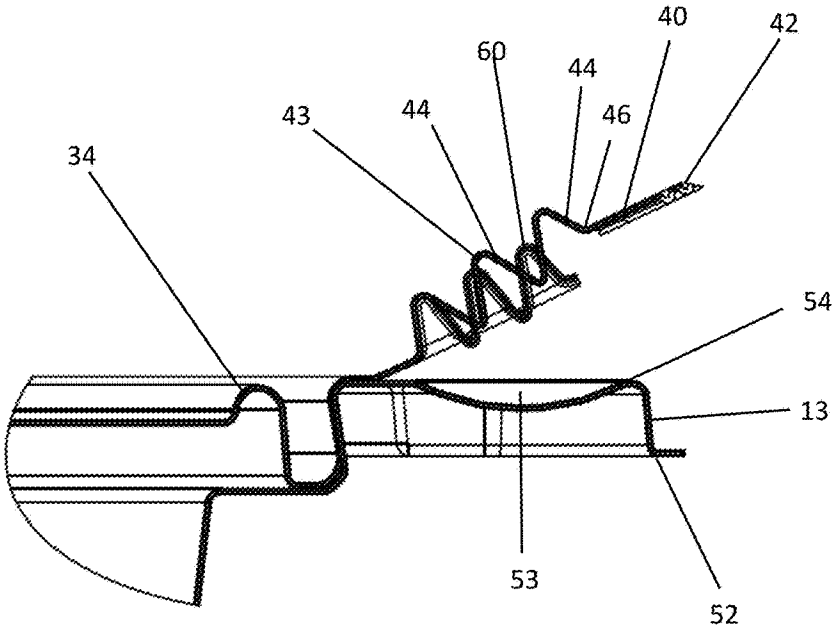
FIG. 33 is a detail side elevation section view of a preferred embodiment accordiated pull tab on the third embodiment of the present invention container in the initially sealed, but tab-employed state.
Figure 34:
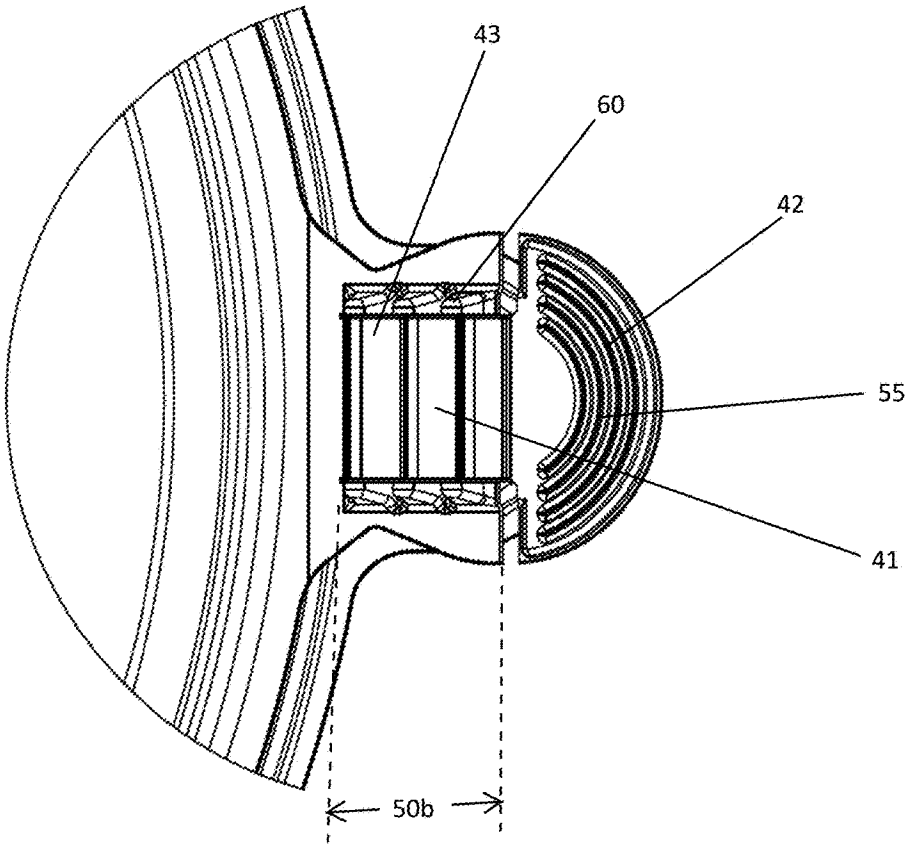
FIG. 34 is a detail top plan view of the accordiated pull tab on the still initially sealed third embodiment container after the pull tab has been initially pulled and separated from the projecting portion.

As explained below, lid 2 is unsealed from base 3 through application of a sustained pulling force to pull tab 40. Upon application of an initial pulling force to pull tab 40 one or more frangible bridges 48*a*, 48*b* connecting pull tab 40 to projecting portion 6 are caused to break. Further application of a pulling force on pull tab 40, particularly in an upward manner, results in unsealing lid 2 from base 3. Thus, container 201 and pull tab 40 can assume a tab-employed state or arrangement prior to actually opening container 201. This state is shown in FIGS. 33, 34. Additionally, container 201, after being unsealed from the initially sealed state can be re-sealed (closed). In this re-sealed state, container 201 would appear as in FIGS. 33, 34.

Figure 15:
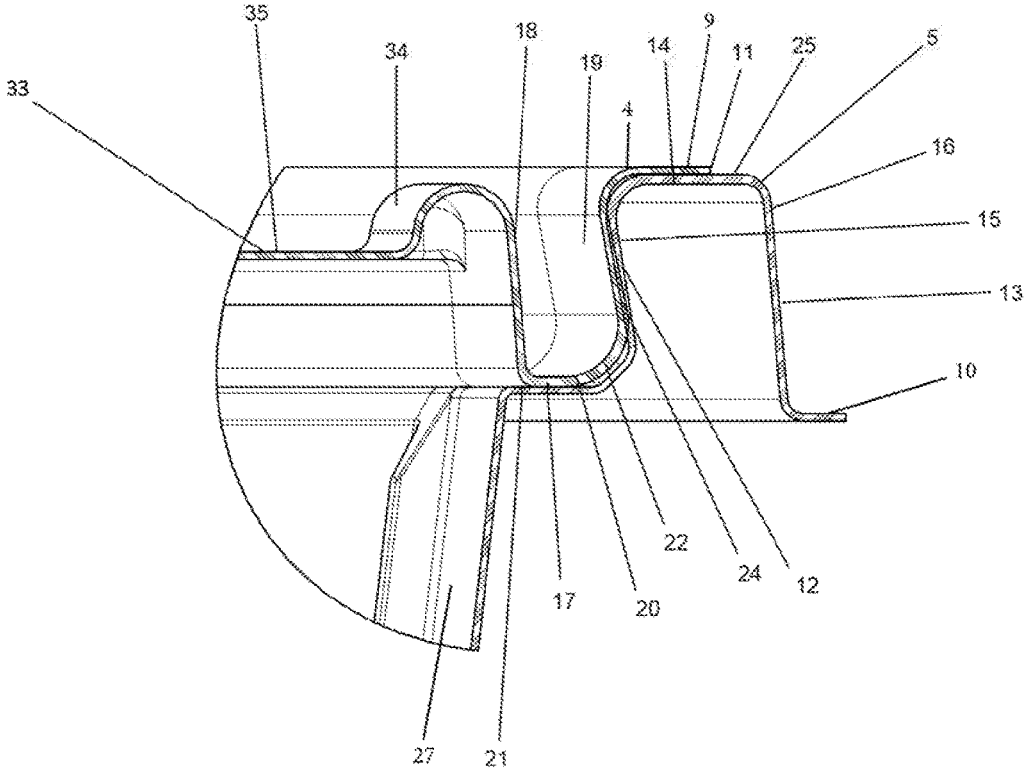
FIG. 15 is a cross section view showing the components and positional relationship of the structures of the lid rim and base rim of the embodiment container of FIGS. 21-35 in the initially sealed state.
Figure 16:
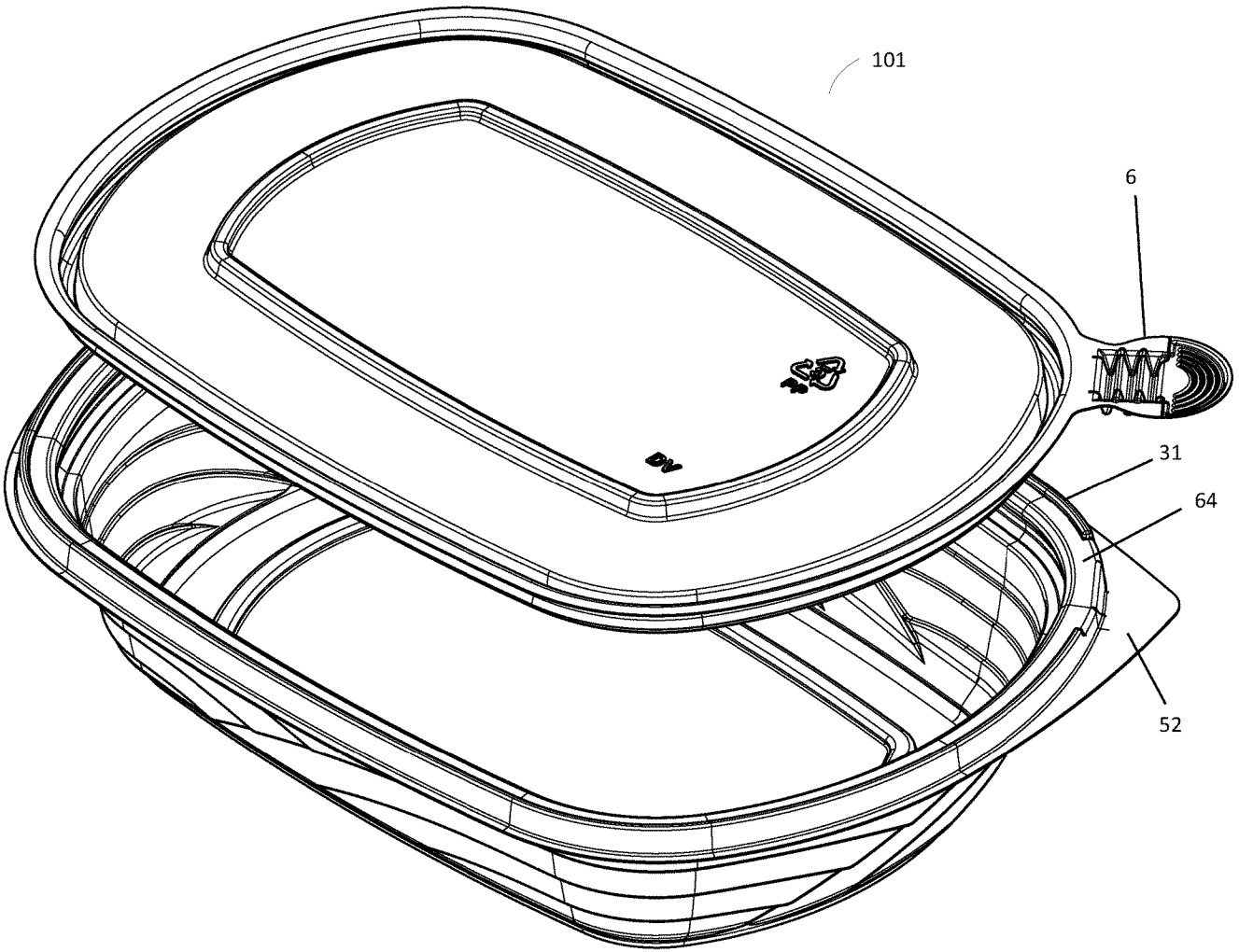
FIG. 16 is an exploded perspective view of the lid and base of a second embodiment of the present invention container in the loading state.

As seen in the figures, third embodiment container 201 comprises lid 2 and base 3. Lid 2 includes cover portion 33 and lid rim 4. Lid rim 4 circumferentially extends about the periphery of lid 2. FIG. 15 depicts preferred embodiment rim structural features that make the third embodiment container not just tamper evident, but also tamper resistant. In the preferred embodiment, lid rim 4 includes lid rim bead 17 that comprises a downwardly descending lid rim inner vertical wall 18, an upwardly extending lid rim outer wall 19 and a bead bottom segment 20. Bead bottom segment 20 extends from the bottom 21 of lid rim inner wall 18 and curves into the bottom 22 of the lid rim outer wall 19. Base 3 includes base rim 5 circumferentially extending about the periphery of base 3. Base rim 5 includes base rim bead 11 that comprises upwardly extending inner vertical wall 12, downwardly extending outer wall 13 and bead top segment 14. Bead top segment 14 extends from top 15 of upwardly extending inner vertical wall 12 to top 16 of the downwardly extending outer wall 13. Upwardly extending inner wall 12 includes undercut surface 24 configured (shaped and sized) to receive and frictionally engage outer wall 19 of lid rim 4 when container 201 is in the sealed or dosed arrangement. When container 201 is in the sealed arrangement lid rim flange 9 assumes a position above or on top of the top surface 25 of top segment 14 of base rim bead 11. As the figures also show, lid rim 4 is structured such that it includes lid rim flange 9 connected to lid rim outer wall 19. Lid rim outer wall 19 is of such height that lid rim flange 9 is positioned higher than cover portion 33 of lid 2. As an added tamper resistance feature against prying or grasping of the lid rim, cover portion 33 includes one or more elongate cover beads 34 protruding upward from the outer surface 35 of cover portion 33. Bead 34 is optimally positioned 5 millimeters or less from lid rim outer wall 19 to prevent grasping of lid rim flange 9.

In the context of container 201, the inventive pull tab 40 of the present invention is best seen in FIGS. 26-29, 33 and 34. Container 201 includes projecting portion 6 integrally formed in and projecting outwardly from lid 2, preferably from lid rim 4. In the preferred embodiment, projecting portion 6 is integrally formed in and projects outwardly from lid rim flange 9. Projecting portion 6 includes pull tab 40 that comprises accordiated section 41 connected to gripping tip 42. Accordiated section 41 comprises at least one pleat 43. In the depicted embodiment, pull tab 40 of container 201 has three pleats 43, but could have more or less. At least one pleat 43 preferably comprises two legs 44. Each leg 44 has a top 45 and a bottom 46. Legs 44 converge at their tops 45 to meet at peak 47.

Figure 35A:
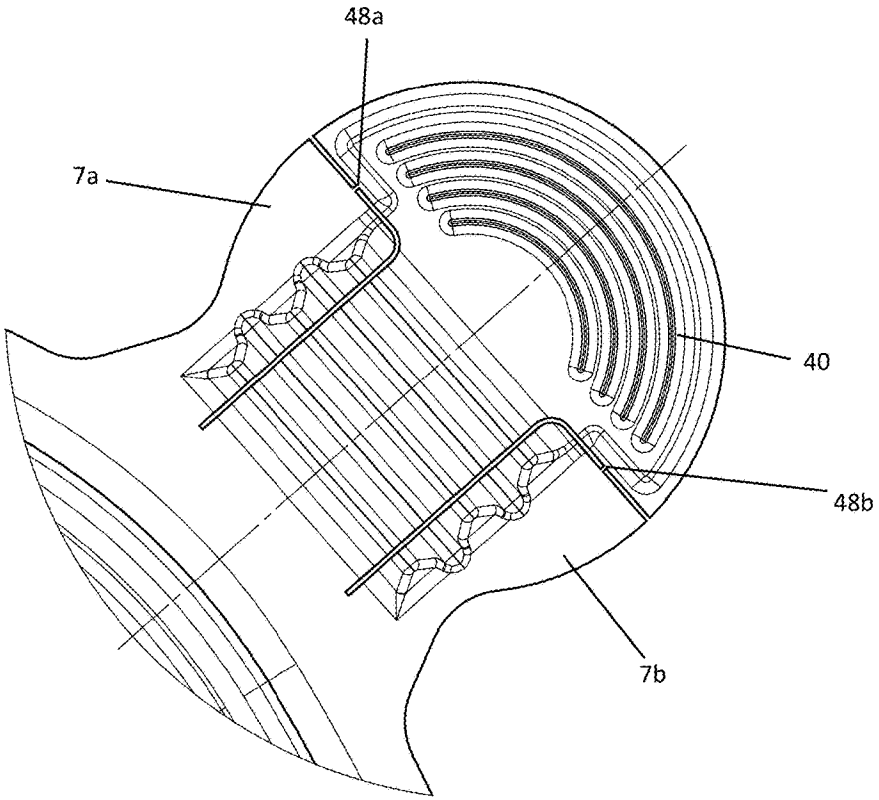
FIGS. 35A-35C are top plan views of embodiment projecting portions for which the location of frangible bridges vary on the projecting portion.
Figure 35B:
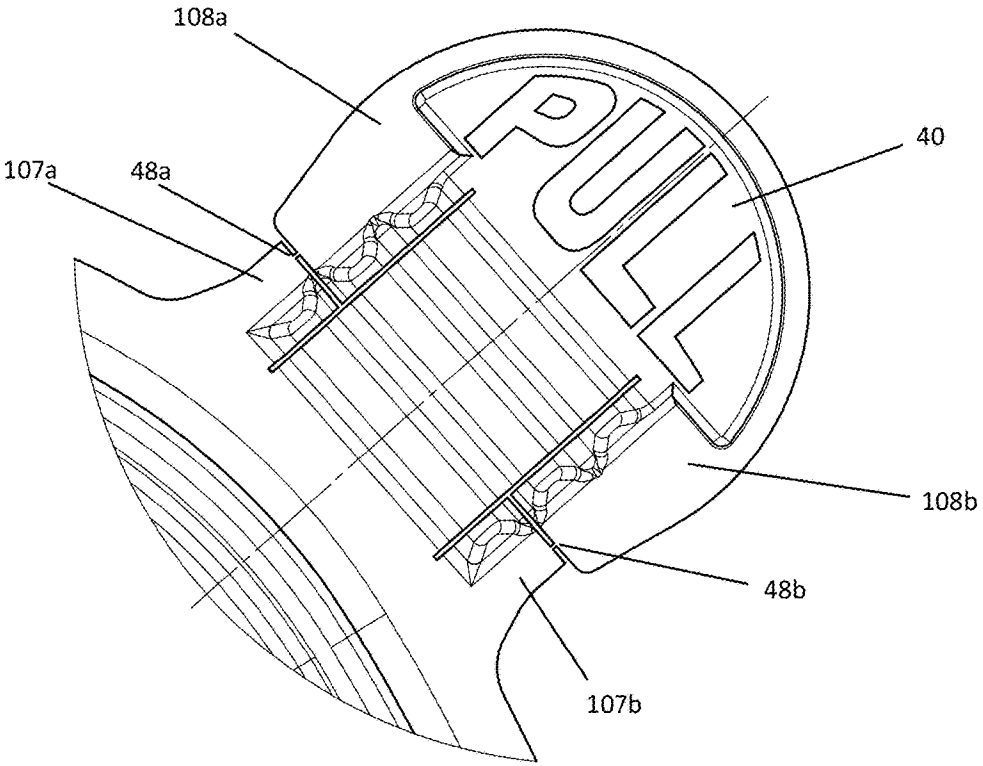

The present invention container 201 includes projecting portion 6. Projecting portion 6 includes one or more shoulders 7*a*, 7*b*. The exemplary embodiment of FIGS. 26-29, 33 and 34 can have frangible bridges 48*a* and 48*b* that can respectively connect at least one pleat 43 to shoulders 7*a*, 7*b* or can connect pull tab 40 to shoulders 7*a*, 7*b* as is shown in FIG. 35B. When container 201 is in the loading state or the initially sealed state, accordiated section 41 has a first length 50*a*, which for visual comparison purposes can be measured relative to projecting portion 6. Accordiated section 41 also preferably has a first orientation 51*a*, which for discernment purposes can be more easily seen relative to projecting portion 6 and base 3. Frangible bridges 48*a*, 48*b* rupture upon the application of a pulling force to pull tab 40 when container 201 is in the initially sealed state. When frangible bridges 48*a*, 48*b* rupture, accordiated section 41 has a second length 50*b* visibly different from first length 50*a*.

In the preferred embodiment, base rim 5 includes base rim projecting platform 52. When container 201 is in the initially sealed state, projecting portion 6 superposes over base rim projecting platform 52. Projecting portion 6 constitutes a localized planar extension of peripheral projecting lid rim flange 9. On the other hand, platform 52 preferably includes outer wall 13 to add rigidity to platform 52. Thus, when container 201 is closed, projecting platform 52 helps protect projecting portion 6 and its integral pull tab 40 from compression damage or being inadvertently snagged. To aid in grasping gripping tip 42, platform 52 may include cavity 53 on platform surface 54. Gripping tip 42 preferably includes surface texture 55 to aid in holding gripping tip 42. In the depicted embodiment, surface texture 55 is exemplarily shown as arcuate ribs, but could include other known textures including differently shaped ribs, knurling, raised bumps or lettering. Platform 52 also serves to provide a visible reference for the orientation of projecting portion 6 both before and after activation of pull tab 40. In this respect, accordiated section can also be formed with a strong memory such that the rupturing of one or more frangible bridges 48*a*, 48*b* causes projecting portion 6 to have a second orientation 51*b* visibly different from first orientation 51*a*. As used herein, the term "orientation" in reference to projecting portion 6 means its orientation relative to the container's horizontal direction, which horizontal direction platform 52 serves to emphasize and delineate. Thus, when frangible bridge 50*a* ruptures, the memory in accordiated section 41 causes at least pull tab 40 to angle upward and increase distance from platform 52.

The preferred embodiment projection portion has at least one frangible bridge, but is discussed and shown in the drawings in a preferred embodiment with two frangible bridges, which provide symmetry and balance to projecting portion 6 and pull tab 40. Similarly, in the preferred embodiment, projecting portion includes two shoulders, first shoulder 7*a* and a second shoulder 7*b*. Thus, by way of example, in one embodiment, the projecting portion could include first frangible bridge 48*a* connecting the at least one pleat 43 to first shoulder 7*a* and a second frangible bridge 48*b* connecting the at least one pleat 43 to second shoulder 7*b*. When container 201 is in the loading state or the initially sealed state, accordiated section 41 has a first length 50*a* and a first orientation 51*a* relative to projecting portion 6. First and second frangible bridges 48*a*, 48*b* rupture upon the application of a pulling force to pull tab 42 when container 201 is in the initially sealed state. When frangible bridges 48*a*, 48*b* rupture, accordiated section 41 has a second length 50*b* that is visibly different from first length 50*a*. The rupturing of frangible bridges 48*a*, 48*b* also preferably causes projecting portion 6 to visibly change orientation from first orientation 51*a* to second orientation 51*b* as shown in the figures. In the preferred embodiment, lid rim 4 includes lid rim flange 9 and projecting portion 6 is integrally formed in and projects outwardly from lid rim flange 9.

Frangible bridges 48*a*, 48*b* are formed as a relatively weaker material than pleat 43, shoulders 7*a*, 7*b*, or flange 9. By virtue of being formed of weakened material, frangible bridges 48*a*, 48*b* rupture upon the application of a first pulling force to pull tab 40 when the container is in the initially sealed state. Ideally, this first pulling force should be significantly less than the pulling force necessary to unseal lid 2 from base 3, though testing on prototypes indicates that it is not necessarily the peak force differences between bridge frangibility and container separability, but the amount of work that determines optimum operation. In the depicted preferred embodiment, projecting portion 6 has two shoulders, first shoulder 7*a* and second shoulder 7*b* and pull tab 40 is interposed between shoulders 7*a*, 7*b*. In one embodiment, frangible bridges, 48*a*, 48*b* each respectively connect to shoulders 7*a*, 7*b* via a riser 60. When container 201 is in the loading state or the initially sealed state, the at least one pleat 43 in accordiated section 41 is connected to projecting portion 6. In the depicted preferred embodiment this connection is achieved by a first frangible bridge 48*a* extending from pleat 43 to riser 60 on first shoulder 7*a* and by second frangible bridge 48*b* extending from pleat 43 to riser 60 on second shoulder 7*b*. When the at least one pleat 43 is connected in such fashion, accordiated section 41 has a visible first length 50*a* and a first orientation 51*a* (substantially parallel) relative to projecting portion 6. In the figures showing a preferred embodiment projecting portion 6 in which accordiated section 41 has three pleats 43, each pleat 43 is thus bookended by a pair of risers 60. Risers 60 are shaped similarly to a transverse cross-section of pleats 43 in terms of leg length and the angle between legs 44. In the depicted embodiment first frangible bridge 48*a* and second frangible bridge 48*b* are integrally formed in projecting portion 6 and can be formed by thinning, scoring or skip-perforating (collectively referred to as "weakening") the plastic extending between pleat 43 and riser 60.

As seen in the figures, projecting portion 6 and its associated accordiated section 41 deforms by operation of expansion of pleats 43 and not by operation of serration-like structures such as recesses or ribs (protrusions) formed on its surface. Accordingly, it provides a very reliable and noticeable deformation both in terms of visible difference, plus in terms of tactile feel when the accordiated section 41 "pops" by virtue of the rupturing of frangible bridge 48*a* or bridges 48*a*, 48*b*. However, being of weakened material, frangible bridges 48*a* and 48*b* rupture upon the application of a first pulling force to pull tab 40 when the container is in the initially sealed state. To break frangible bridges 48*a*, 48*b*, an outwardly directed pulling force is applied to pull tab 40 by way of grasping gripping tip 42. Notably, as shown in FIGS. 33-36, when first frangible bridge 48*a* and second frangible bridge 48*b* rupture upon the application of a first pulling force to pull tab 40, accordiated section 41 has a second length 50*b* visibly different from first length 50*a*. In the preferred embodiment, it also has a second orientation 51*b* visibly different from first orientation 51*a*. In the preferred embodiment, second orientation 51*b* is visibly angled upward from projecting portion 6 in relation to its previous parallel or flush position with projecting portion 6 due to being fixed by frangible bridges 48*a*, 48*b*.

Figure 35C:
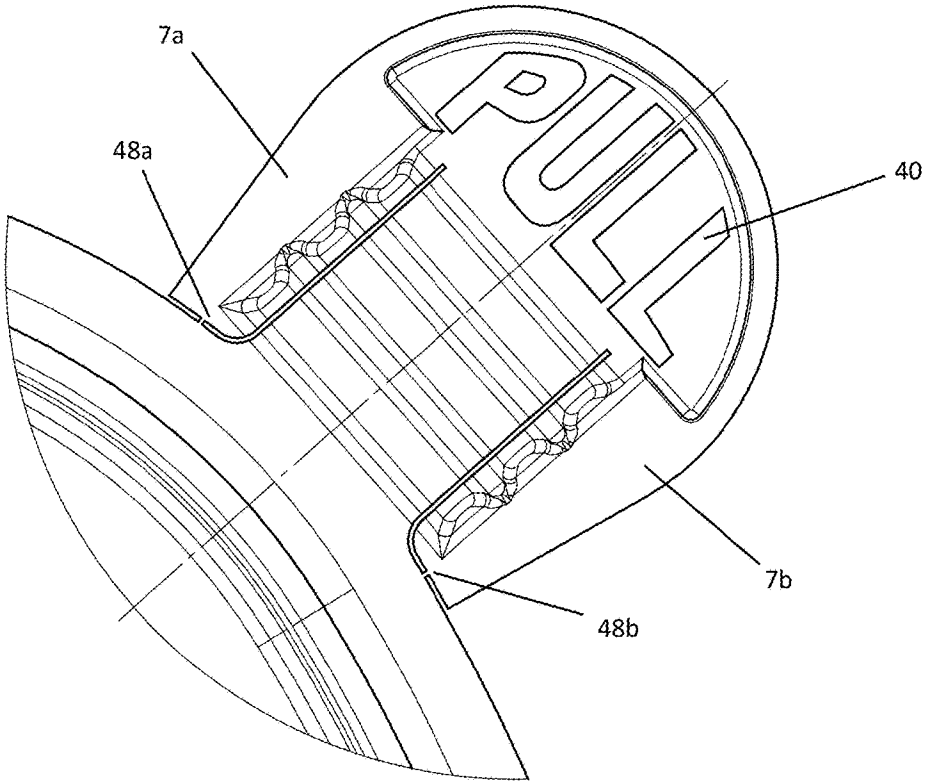

In the embodiment in which the a frangible bridge connects to a pleat, it is preferred that the frangible bridge be located at the point where it can extend directly from the pleat to the shoulder. Moreover, though FIGS. 1-34 show a preferred embodiment projecting portion 6 in which frangible bridges 48*a*, 48*b* respectively connect at least one pleat 43 to risers 60 on shoulders 7*a*, 7*b*, this is merely an illustrative embodiment. In alternative embodiments of projecting portion 6, the one or more one frangible bridge 48*a*, 48*b* could be respectively located between shoulders 7*a*, 7*b* and pull tab 40. This is shown in FIG. 35A. Alternatively, as shown in FIG. 35B, projecting portion 6 could comprise first proximal shoulder 107*a*, second proximal shoulder 107*b*, first distal shoulder 108*a* and second distal shoulder 108*b*. In this embodiment frangible bridge 48*a* could be located between first proximal shoulder 107*a* and first distal shoulder 108*a*. A second frangible bridge 48*b* could be located between second proximal shoulder 107*b* and second distal shoulder 108*b*. In tests of various pull tab and projecting portion configurations, the configuration of the projecting portion shown in FIG. 35C has shown to work best to ensure that end users grasp the portion of the pull tab that is distal to the frangible bridges. When a user grasps beyond the gripping tip 42 of pull tab 40 of projecting portion 6 such that he or she grasps a portion of projecting portion 6 that is proximal to frangible bridges 48*a*, 48*b*, then it is possible that the user could pull the lid and base apart without rupturing the frangible bridges 48*a*, 48*b*. Thus, as is shown in FIG. 35C, a preferred embodiment container and projecting portion would have a frangible bridge extending from a shoulder 7*a* of projecting portion 6 to flange 9 of lid rim 4. In the shown preferred embodiment of FIG. 35C, the container has a first frangible bridge 48*a* extending from shoulder 7*a* to flange 9 and a second frangible bridge 48*b* extending from shoulder 7*b* to flange 9.

Referable to FIGS. 35A-35C, in tests of prototypes, placing of the bridge wholly in the shoulder or at its proximal end nearest the lid flange aided break consistency. Additionally, though the frangible bridge may be formed as a web extending between structures, in the preferred embodiments, the frangible bridge is a distinct point between structures. It is also preferable that the gripping tip be as distant as possible from the frangible bridges. Doing so ensures that end users grab the gripping tip and not the entire projecting portion or the entire pull tab. Additionally, though for simplicity's sake the pull tab is shown to deform in one direction, depending on how (i.e., what direction) the pull tab is pulled, the pull tab can achieve a second orientation in which it is up, down or a combination of off to a side relative to its first orientation. The key is that the pull tab is always different from the first or original orientation when the container is first loaded and closed.

A container and projecting portion constructed in accordance with the present invention can be manufactured in a variety of shapes and sizes, and is preferably formed of resins or plastic materials including, but not limited to, polyethylene, polypropylene, polyvinyl chloride, polyethylene terephthalate ("PET") or high impact polystyrene ("HIPS"). The container is preferably thermoformed, but can be blow-molded or injection molded. The container lid and base, as well as the projecting portion, can be transparent or translucent, and may be colored in either instance. The container can be provided with vents to promote the flow of air or steam in or out of the container. Further, the container can be of any shape, including round or polygonal. As shown in the figures, the rim structures of the container may be adapted to include a hinge such that the lid and base are connected to each other in a clamshell configuration.

Having described the invention in detail, those skilled in the art will appreciate that modifications may be made of the invention without departing from its spirit. Therefore, it is not intended that the scope of the invention be limited to the specific embodiment illustrated and described.

What is claimed is:

1. A plastic container capable of assuming a loading state, an initially sealed state and an opened state, the plastic container comprising:

a lid including a lid rim;

a base including a bottom, a base rim and a side wall extending upwardly from the bottom to the base rim, the side wall surrounding the bottom;

the lid rim formed for sealing engagement with the base rim;

a projecting portion projecting outwardly from the lid;

the projecting portion including an accordiated section connected to a pull tab;

the accordiated section comprising at least one pleat;

when the plastic food container is in the initially sealed state the accordiated section has a first length and a first orientation;

the projecting portion further having a frangible bridge;

the frangible bridge rupturing upon the application of a first pulling force to the pull tab when the container is in the initially sealed state;

when the frangible bridge ruptures, the accordiated section has a second length visibly longer than the first length; and after the frangible bridge has ruptured, the lid separates from the base upon the further application of a pulling force applied to the pull tab.

2. The plastic container of claim 1 wherein the at least one pleat comprises two legs, each leg having a top and bottom and the two legs converging at their tops to meet at a peak.

3. The plastic container of claim 1 wherein:

the lid rim includes a peripherally projecting lid rim flange;

the projecting portion includes a shoulder; and the frangible bridge connects the shoulder to the lid rim flange.

4. The plastic container of claim 1, wherein the base rim includes a base rim projecting platform and when the container is in the initially sealed state the projecting portion superposes over the base rim projecting platform.

5. The plastic container of claim 3, wherein the base rim includes a base rim projecting platform and when the container is in the initially sealed state the projecting portion superposes over the base rim projecting platform.

6. The plastic container of claim 1 wherein when the frangible bridge ruptures, the accordiated section has a second orientation.

7. The plastic container of claim 3 wherein when the frangible bridge ruptures, the accordiated section has a second orientation.

8. The plastic container of claim 5 wherein when the frangible bridge ruptures, the accordiated section has a second orientation.

9. The plastic container of claim 1 wherein the base rim includes a base rim bead and when the container is in the initially sealed state the base rim bead contacts the projecting portion and causes the projecting portion to angle upwardly.

10. A plastic container capable of assuming a loading state, an initially sealed state and an opened state, the plastic container comprising:

a lid including a lid rim;

a base including a bottom, a base rim and a side wall extending upwardly from the bottom to the base rim, the side wall surrounding the bottom;

the lid rim formed for sealing engagement with the base rim;

a projecting portion projecting outwardly from the lid;

the projecting portion including an accordiated section connected to a pull tab;

the accordiated section comprising at least one pleat;

when the plastic food container is in the initially sealed state the accordiated section has a first length and a first orientation;

the projecting portion having a first frangible bridge and a second frangible bridge;

the first frangible bridge and the second frangible bridge rupturing upon the application of a first pulling force to the pull tab when the container is in the initially sealed state;

when the first frangible bridge and second frangible bridge rupture, the accordiated section has a second length visibly longer than the first length; and after the first frangible bridge and second frangible bridge have ruptured, the lid separates from the base upon the further application of a pulling force applied to the pull tab.

11. The plastic container of claim 10 wherein the at least one pleat comprises two legs, each leg having a top and bottom and the two legs converging at their tops to meet at a peak.

12. The plastic container of claim 10 wherein:

the projecting portion includes a first shoulder and a second shoulder;

the lid rim includes a peripherally projecting lid rim flange; and the first frangible bridge connects the first shoulder to the lid rim flange and the second frangible bridge connects the second shoulder to the lid rim flange.

13. The plastic container of claim 10, wherein the base rim includes a base rim projecting platform and when the container is in the initially sealed state the projecting portion superposes over the base rim projecting platform.

14. The plastic container of claim 12, wherein the base rim includes a base rim projecting platform and when the container is in the initially sealed state the projecting portion superposes over the base rim projecting platform.

15. The plastic container of claim 10 wherein when the first and second frangible bridges rupture, the accordiated section has a second orientation.

16. The plastic container of claim 14 wherein when the first and second frangible bridges rupture, the accordiated section has a second orientation.

17. The plastic container of claim 10 wherein the base rim includes a base rim bead and when the container is in the initially sealed state the base rim bead contacts the projecting portion and causes the projecting portion to angle upwardly.

18. A projecting portion integrally formed in and projecting outwardly from a plastic container, the plastic container having a lid rim for sealing engagement upon a base rim and being capable of assuming a loading state, an initially sealed state and an opened state, the projecting portion comprising:

an accordiated section connected to a pull tab;

the accordiated section comprising at least one pleat;

a frangible bridge;

the accordiated section having a first length and a first orientation when the frangible bridge is intact;

the frangible bridge rupturing upon the application of a first pulling force to the pull tab when the container is in the initially sealed state, the first pulling force being less than a second pulling force applied to the pull tab that is required to separate the lid from the base;

the accordiated section having a second length when the frangible bridge is ruptured; and the second length being visibly longer from the first length.

19. The projecting portion of claim 18 wherein the accordiated section has a second orientation when the frangible bridge is ruptured and the second orientation is visibly different from the first orientation.

20. The projecting portion of claim 18 wherein the at least one pleat comprises two legs, each leg having a top and bottom and the two legs converging at their tops to meet at a peak.

21. The projecting portion of claim 18 wherein:

the projecting portion includes a shoulder; and the frangible bridge connects the shoulder to the lid rim.

22. A projecting portion integrally formed in and projecting outwardly from a plastic container, the plastic container having a lid rim for sealing engagement upon a base rim and being capable of assuming a loading state, an initially sealed state and an opened state, the projecting portion comprising:

an accordiated section connected to a pull tab;

the accordiated section comprising at least one pleat;

a first shoulder and a second shoulder;

a first frangible bridge and a second frangible bridge;

the accordiated section having a first length and an orientation when the first and second frangible bridges are intact;

the first frangible bridge and the second frangible bridge rupturing upon the application of a first pulling force to the pull tab when the container is in the initially sealed state, the first pulling force being less than a second pulling force applied to the pull tab that is required to separate the lid from the base; and when the first frangible bridge and the second frangible bridge rupture, the accordiated section has a second length visibly longer than the first length.

23. The projecting portion of claim 22 wherein the accordiated section has a second orientation when the first and second frangible bridges are ruptured and the second orientation is visibly different from the first orientation.

24. The projecting portion of claim 22 wherein:

the first frangible bridge connects the first shoulder to the lid rim; and the second frangible bridge connects the second shoulder to the lid rim.

* * * * *